US008016556B2

(12) United States Patent
Teshima et al.

(10) Patent No.: US 8,016,556 B2
(45) Date of Patent: Sep. 13, 2011

(54) CENTRIFUGAL FAN

(75) Inventors: Hiroyoshi Teshima, Kyoto (JP); Kazumi Takeshita, Kyoto (JP); Hideaki Konishi, Kyoto (JP); Kiyoto Ida, Kyoto (JP); Tsukasa Takaoka, Kyoto (JP)

(73) Assignee: Nidec Corporation, Kyoto (JP)

( * ) Notice: Subject to any disclaimer, the term of this patent is extended or adjusted under 35 U.S.C. 154(b) by 1219 days.

(21) Appl. No.: 11/716,644

(22) Filed: Mar. 12, 2007

(65) Prior Publication Data

US 2007/0212219 A1 Sep. 13, 2007

(30) Foreign Application Priority Data

Mar. 13, 2006 (JP) ..... 2006-066932

(51) Int. Cl.
*F04D 29/42* (2006.01)

(52) U.S. Cl. ..... 415/206; 415/204; 415/214.1; 417/423.14; 310/71; 174/72 A; 174/96; 174/97; 174/101

(58) Field of Classification Search ..... 415/203, 415/204, 206, 214.1; 417/352–354, 423.1, 417/423.14, 423.15; 310/62, 63, 67 R, 71; 174/68.1, 68.3, 72 A, 101, 96–98
See application file for complete search history.

(56) References Cited

U.S. PATENT DOCUMENTS

| | | | | | |
|---|---|---|---|---|---|
| 4,164,690 | A * | 8/1979 | Muller et al. | ..... | 417/423.7 |
| 5,699,854 | A * | 12/1997 | Hong | ..... | 165/121 |
| 6,162,016 | A * | 12/2000 | Humbad | ..... | 415/204 |
| RE37,261 | E | 7/2001 | Schmider et al. | | |
| 2005/0095125 | A1 * | 5/2005 | Chang et al. | ..... | 415/206 |
| 2005/0207888 | A1 * | 9/2005 | Kashiwazaki et al. | ..... | 415/206 |
| 2007/0194668 | A1 * | 8/2007 | Teshima et al. | ..... | 310/67 R |

FOREIGN PATENT DOCUMENTS

| | | | |
|---|---|---|---|
| JP | 2001-241 395 | A * | 9/2001 |
| JP | 2001-241395 | A | 9/2001 |
| JP | 2005-245 172 | A * | 9/2005 |
| JP | 2005-245172 | A | 9/2005 |

* cited by examiner

*Primary Examiner* — Christopher Verdier
(74) *Attorney, Agent, or Firm* — Westerman, Hattori, Daniels & Adrian, LLP

(57) ABSTRACT

A centrifugal fan includes a motor having an impeller and a housing for accommodating the motor. The housing has a sidewall surrounding an outer circumference of the impeller. An air inlet is formed in the housing and opposed to a center portion of the impeller. An air outlet is formed in the sidewall of the housing and opposed to an outer surface of the impeller. The housing includes a housing body and a housing cover. The housing body has a bottom with the motor secured thereon. The housing cover, formed by a pressed metal member, has an upper part and a cover sidewall extending from the upper part toward the bottom of the housing body and forming at least a part of the sidewall of the housing.

13 Claims, 19 Drawing Sheets

CENTRIFUGAL FAN

BACKGROUND OF THE INVENTION

1. Field of the Invention

The present invention relates to an electric centrifugal fan used for blowing air.

2. Description of the Related Art

Centrifugal fans are conventionally used for cooling devices in various electronic devices. The centrifugal fans include an impeller having a plurality of blades inside a housing, and draw air in an axial direction parallel to a rotation axis of the impeller and discharge the air in a radial direction perpendicular to the axial direction. The housing usually includes a housing body having a bottom on which a motor is secured and a sidewall which defines a passage of an air flow together with the impeller, and a housing cover closing a top of the housing body. The housing body and the housing cover are formed by resin molding. For the housing cover, the use of material excellent in heat radiation other than the resin, such as aluminum, has been proposed (see Japanese Laid-Open Patent Publication No. 2001-241395, [0043]).

In recent years, demands for size reduction for centrifugal fans have increased with size reduction of electronic devices on which the centrifugal fans are to be mounted. To reduce the size of the centrifugal fans, it is necessary to not only reduce the number of components of the centrifugal fans but also make the housing have additional functions the conventional centrifugal fans did not have. For example, U.S. Pat. No. 5,699,854 describes holding of lead wires between the housing body and a downward protrusion formed on the housing cover.

In a case of forming the entire housing by resin molding, the sidewall of the housing has to have a certain thickness in order to obtain a required strength. It is therefore difficult to reduce the size of the housing, while ensuring a large passage for an air flow formed between the impeller and the sidewall of the housing and keeping an air flow rate at an adequate level.

SUMMARY OF THE INVENTION

According to preferred embodiments of the present invention, a centrifugal fan includes a motor having an impeller and a housing for accommodating the motor. The housing has a sidewall at least partially surrounding an outer circumference of the impeller. The housing includes an air inlet opposed to a central portion of the impeller and an air outlet formed in the sidewall of the housing to be opposed to the outer circumference of the impeller. The housing includes a housing body having a bottom on which the motor is secured and a housing cover having an upper part and a cover sidewall extending from the upper part toward the bottom of the housing body and forming at least a part of the sidewall of the housing. The housing cover is a pressed metal member.

Other features, elements, advantages and characteristics of the present invention will become more apparent from the following detailed description of preferred embodiments thereof with reference to the attached drawings.

BRIEF DESCRIPTION OF THE DRAWINGS

The above and further features will be more clearly appreciated from the following detailed description when taken in conjunction with the accompanying drawings. In the drawings, like reference numerals indicate like structures. All of these conventions, however, are intended to be typical or illustrative, rather than limiting.

DETAILED DESCRIPTION OF PREFERRED EMBODIMENTS

Figure 1:
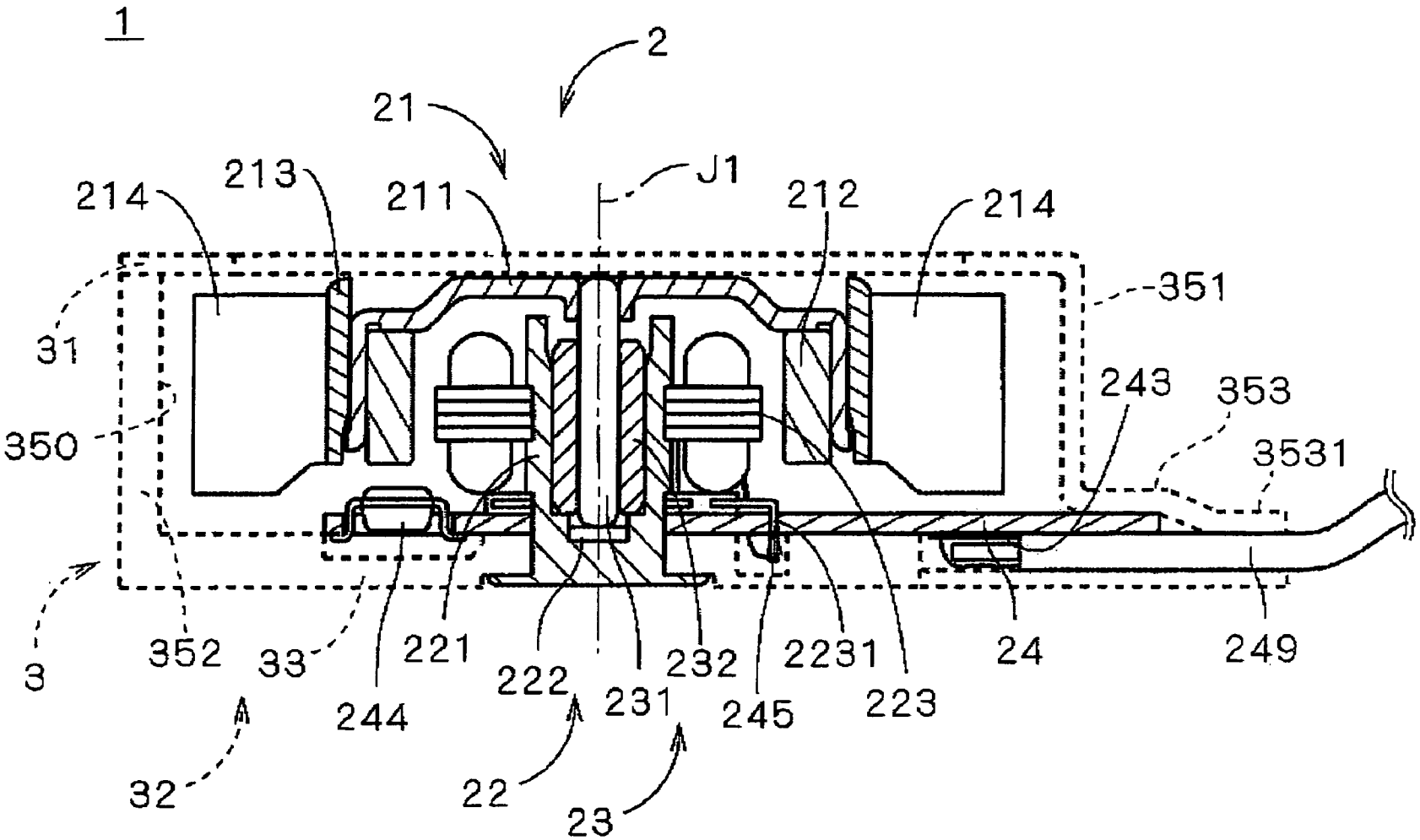
FIG. 1 is a vertical cross-sectional view of a centrifugal fan according to a first preferred embodiment of the present invention.

Referring to FIGS. 1 through 19, preferred embodiments of the present invention will be described in detail. It should be noted that in the explanation of the present invention, when positional relationships among and orientations of the different components are described as being up/down or left/right, ultimately positional relationships and orientations that are in the drawings are indicated; positional relationships among and orientations of the components once having been assembled into an actual device are not indicated. Meanwhile, in the following description, an axial direction indicates a direction parallel to a rotation axis, and a radial direction indicates a direction perpendicular to the rotation axis.

Figure 2:
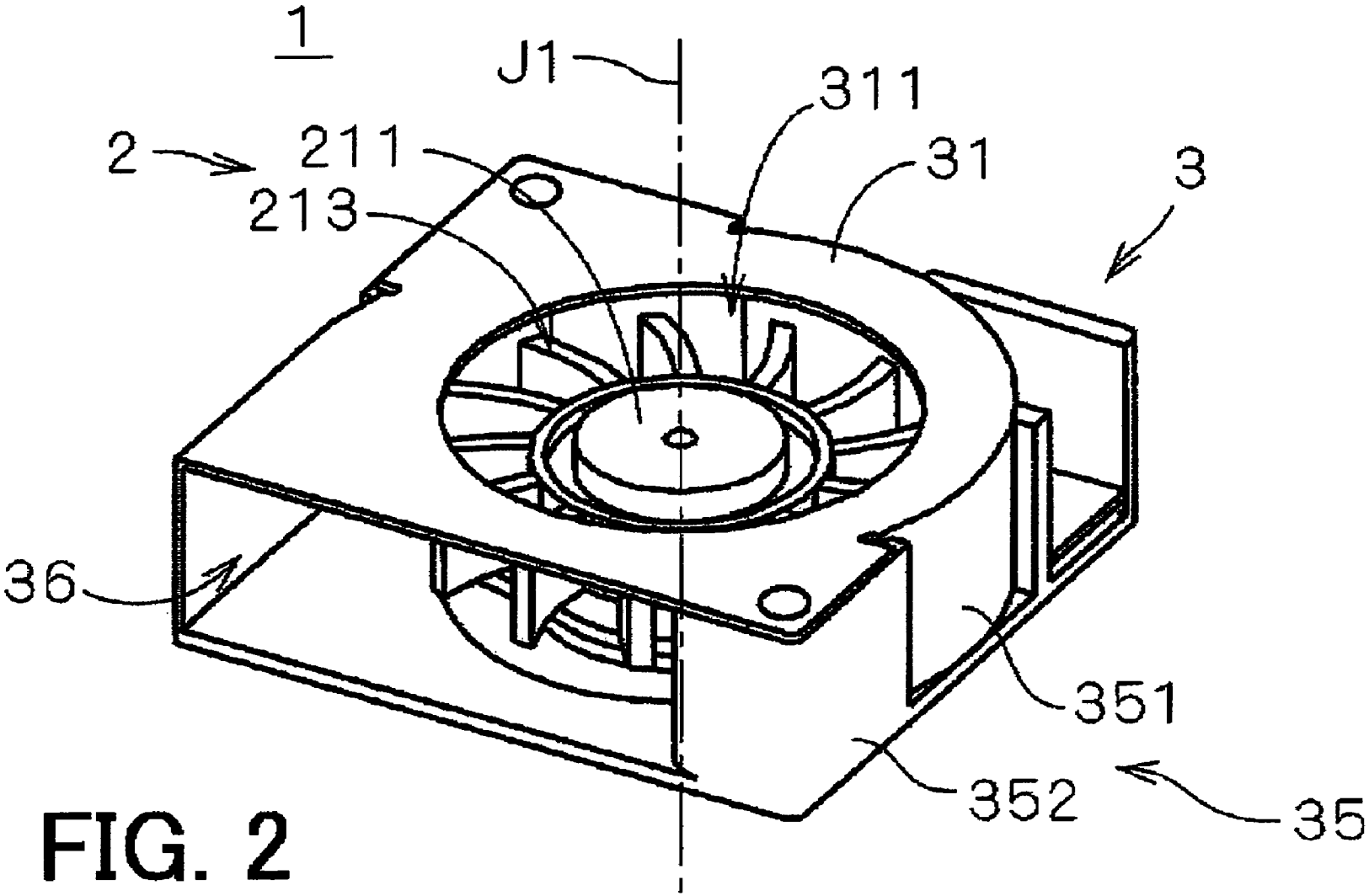
FIG. 2 is a perspective view of the centrifugal fan of FIG. 1.
Figure 3:
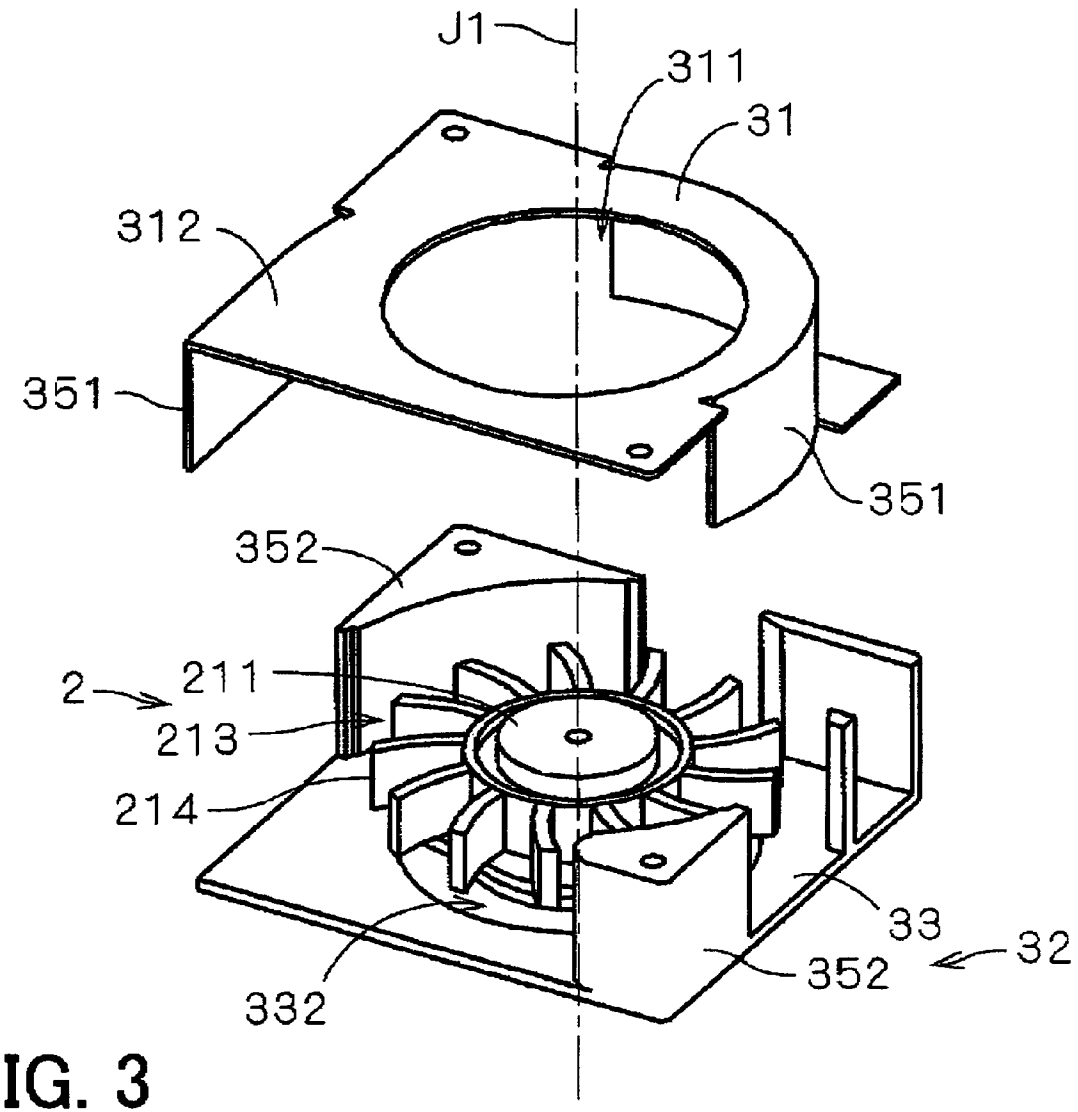
FIG. 3 is an exploded perspective view of the centrifugal fan of FIG. 1.

FIG. 1 is a vertical cross-sectional view of a compact centrifugal fan 1 according to a first preferred embodiment of the present invention. FIG. 2 is a perspective view showing an appearance of the centrifugal fan 1 of FIG. 1. FIG. 3 is a perspective view of the centrifugal fan 1 in which only a housing cover 31 is removed. Please note that details of the centrifugal fan 1 are omitted in FIGS. 2 and 3.

Referring to FIGS. 1 to 3, the centrifugal fan 1 includes a motor 2. The motor 2 has an impeller 213 rotatable around a rotation axis J1. The centrifugal fan 1 also includes a housing 3 accommodating the motor 2. In the present embodiment, the housing 3 has a shape of an approximately rectangular solid. The housing 3 includes a sidewall surrounding an outer circumference of the impeller 213. An opening 36 is formed in the sidewall, i.e., one side face of the housing 3 to be opposed to the outer circumference of the impeller 213, as shown in FIG. 2. Hereinafter, the opening 36 will be referred to as an air outlet 36 because an air flow generated by rotation of the impeller 213 exits from the centrifugal fan 1 through the opening 36, as described later. Moreover, another opening 311 is provided in an upper face of the housing 3 (i.e., an upper face of the housing cover 31). The opening 311 serves as an air inlet of the centrifugal fan 1, as described later. As shown in FIG. 3, when the housing cover 31 is combined with a housing body 32, the housing 3 shown in FIGS. 1 and 2 is formed.

Please note that, in the present application, faces of the housing 3 which are perpendicular to the rotation axis J1 of the impeller 213 are referred to as upper and lower faces or first and second faces, respectively. In addition, a face or a wall of the housing 3 opposed to the outer circumference of the impeller 213 is referred to as a side face or a sidewall of the housing 3. As described above, the air inlet 311 is formed in the upper face of the housing 3 and the air outlet 36 is formed in the sidewall of the housing 3.

Referring to FIG. 1, the motor 2 includes a rotor 21 as a rotating assembly and a stator 22 as a fixed assembly. The rotor 21 is supported by a bearing assembly 23 using oil to be rotatable relative to the stator 22. The rotor 21 includes an approximately cylindrical cup portion 211 open toward the stator 22 (i.e., downward in FIG. 1). The rotor 21 also includes an approximately cylindrical impeller 213 with its center located on the rotation axis J1. A plurality of blades 214 are formed on an outer circumferential surface of the impeller 213. An outer diameter of the cup portion 211 is preferably approximately 8 mm. However, in actual fans, the outer diameter of the cup portion 211 is approximately 10 mm or less, considering a tolerance and the like. For technical reasons, the cup portion 211 is designed to have an outer diameter of approximately 4 mm or more. The cup portion 211 is inserted into and secured to the inside of the impeller 213, so that the blades 214 are annularly arranged around the rotation axis J1 radially outside the cup portion 211.

A ring-shaped magnet 212 for producing a magnetic field, which is magnetized to achieve a multipole magnet and has a center located on the rotation axis J1, is inserted into the cup portion 211 from below (i.e., from the opening of the cup portion 211) and is attached to an inner circumferential face of the cup portion 211. The top (i.e., upper face) of the cup portion 211 has an insertion hole at its center. A shaft 231 of the bearing assembly 23 is inserted into that insertion hole and a fixed-end of the shaft 231 is secured to the cup portion 211.

A free end of the shaft 231 is inserted into a substantially cylindrical sleeve 232 formed of porous metal impregnated with oil. The sleeve 232 is inserted into and secured to a substantially cylindrical sleeve holder 221 having a bottom. The sleeve holder 221 is attached to the housing body 32 of the housing 3, as described later. Thus, the bearing assembly 23 including the shaft 231 and the sleeve 232 supports the cup portion 211 in such a manner that the cup portion 211 can rotate around the rotation axis J1 relative to the housing 3.

The structure of the bearing assembly 23 is not limited to the above. For example, a bearing assembly using a ball bearing may be used.

On the bottom of the sleeve holder 221, a thrust plate 222 is arranged at a position opposed to an end face of the free end of the shaft 231. The thrust plate 222 is formed of synthetic resin having low friction, and supports the shaft 231 so as to prevent movement of the shaft 231 in an axial direction parallel to the rotation axis J1.

An armature 223 is arranged around the sleeve holder 221. Windings of the armature 223 are connected to terminal pins 2231. Each terminal pin 2231 is inserted into a through hole 245 formed in a circuit board 24, and is soldered to an opposite face of the circuit board 24 to the armature 223. In this manner, the armature 223 can be electrically connected to the circuit board 24 with ease, even if the armature 223 is very small. The circuit board 24 may be flexible. For example, an FPC (Flexible printed circuit board) may be used.

In the centrifugal fan 1, a current supplied from the circuit board 24 to the armature 223 is controlled, thereby generating a torque (rotating force) around the rotation axis J1 between the magnet 212 and the armature 223. That is, the magnet 212 and the armature 223 form a driving section of the centrifugal fan 1. The thus generated torque rotates the impeller 213 secured to the cup portion 211 together with the cup portion 211 in a predetermined rotating direction.

The structure of the housing 3 is now described. Referring to FIGS. 1 and 3, the housing body 32 has a bottom 33 in the form of a plate perpendicular to the rotation axis J1. The circuit board 24 (not shown in FIG. 3) is secured on an upper face (i.e., a face on a housing cover side) of the bottom 33. As shown in FIG. 1, a hole with its center located on the rotation axis J1 is formed in each of the bottom 33 and the circuit board 24 around the rotation axis J1. The sleeve holder 221 is inserted into the holes and is secured to the housing body 32 before the armature 223 is attached to the sleeve holder 221. Then, the armature 223 is attached to the sleeve holder 221, and the shaft 231 of the rotor part 21 is inserted into the sleeve 232. In this manner, the motor 2 is secured to the bottom 33 of the housing body 32.

The entire housing body 32 is formed by resin molding. As shown in FIG. 3, an outer shape of the bottom 33 of the housing body 32 is an approximately square in this embodiment. The bottom 33 has at least one hole 332 in a region to be covered by the impeller 213. The hole 332 serves as an air inlet. In addition, as shown in FIG. 1, at least one pair of a terminal 243 to which a wire 249 (not shown in FIGS. 2 and 3) is to be connected is formed on a lower surface of the circuit board 24 (i.e., a face of the circuit board 24 opposed to the bottom 33). On an upper surface of the circuit board 24, a hole IC 244 for detecting a rotation speed of the motor 2 is provided to be opposed to the magnet 212.

Referring to FIGS. 1 and 3, a part of a sidewall 35 (see FIG. 2) of the housing 3 surrounding the outer circumference of the impeller 213 (corresponding to a path of top ends of the blades 214 in the rotating impeller 213) is formed on the bottom 33 of the housing body 32 as a part of the housing body 32. This part of the sidewall 35 is referred to as a body sidewall 352. Another part of the sidewall 35 is formed as a part of the housing cover 31. This part is referred to as a cover sidewall 351. The cover sidewalls 351 and the body sidewalls 352 substantially continuously surround the outer circumference of the impeller 213 except for a region in which the air outlet 36 (see FIG. 2) is formed. That is, there is no gap between the cover sidewalls 351 and the body sidewalls 352 in a circumferential direction of the impeller 213 except for the region in which the air outlet 36 is formed. In this manner, the impeller 213 and the cup portion 211 are accommodated in the housing 3 while being surrounded by the housing cover 31 and the housing body 32.

Inner faces of the cover sidewalls 351 and body sidewalls 352 define with the outer circumference of the impeller 213 an approximately scroll-like passage to the air outlet 36. A width of the passage in a cross section perpendicular to the rotation axis J1 gradually increases in most centrifugal fans. However, since the centrifugal fan of this preferred embodiment is compact, required functions can be achieved even when the width of the passage in the cross section perpendicular to the rotation axis is constant. In addition, it is not necessary that the cover sidewalls 351 and the body sidewalls 352 form an airtightly sealing structure to such a level that leakage of air can be completely prevented under a high static pressure, as long as the cover sidewalls 351 and the body sidewalls 352 continuously surround the outer circumference of the impeller 213 while being in contact with each other.

When the impeller 213 attached to the cup portion 211 in the centrifugal fan 1 rotates in a counterclockwise direction in FIGS. 2 and 3, an air flow is generated. That is, air near the centrifugal fan 1 is drawn into the housing 3 via both the opening 311 in the housing cover 31 and the hole 332 in the bottom 33 of the housing body 32, is then moved approximately along the rotating direction of the impeller 213 and away from the rotation axis J1, and is finally discharged from the air outlet 36 after flowing through the passage between the impeller 213 and the cover sidewalls 351 and body sidewalls 352. In this manner, the centrifugal fan 1 blows air by drawing the air in the axial direction and discharging the air in a direction away from the rotation axis J1.

Figure 4:
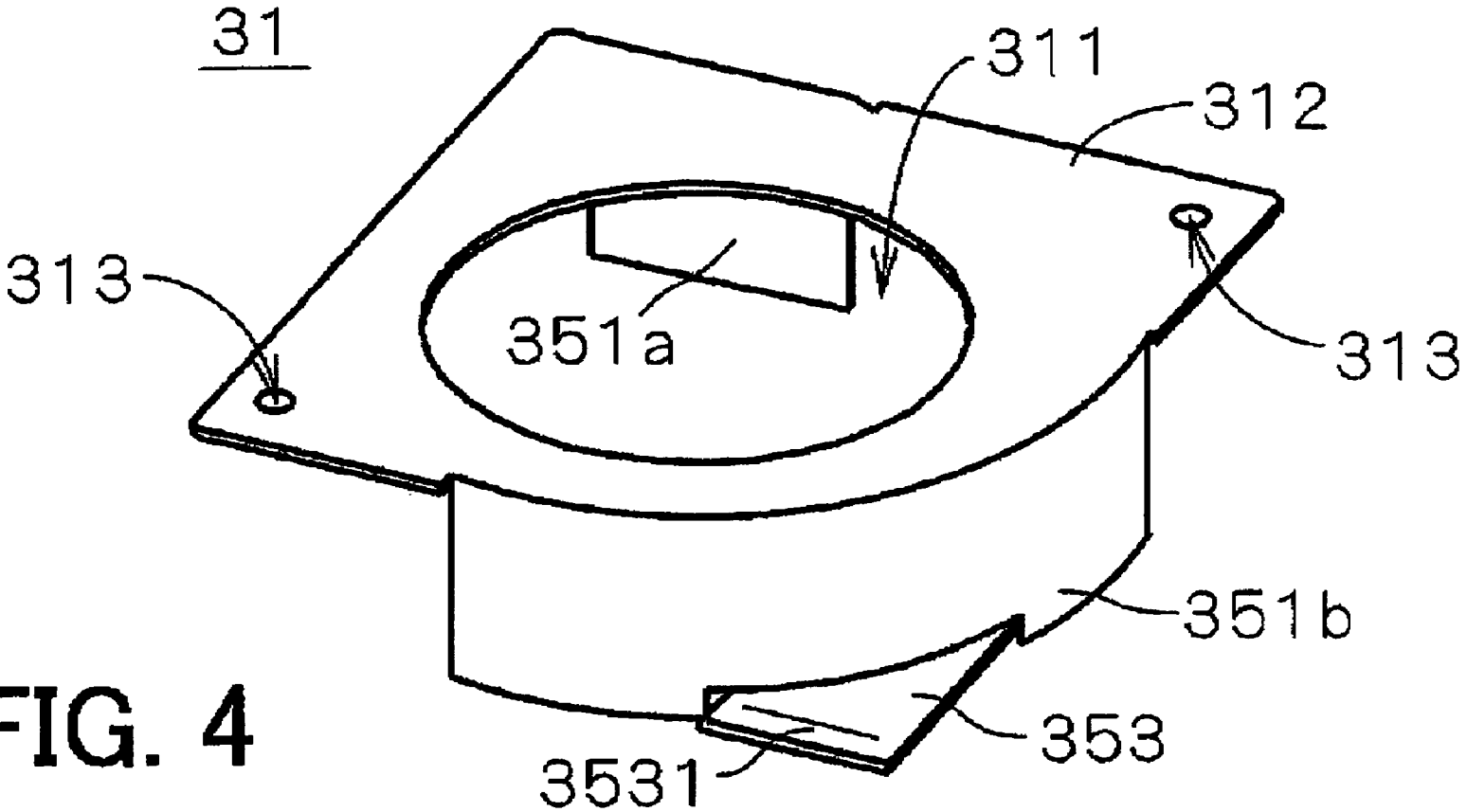
FIG. 4 is a perspective view of a housing cover in the centrifugal fan of FIG. 1.
Figure 5:
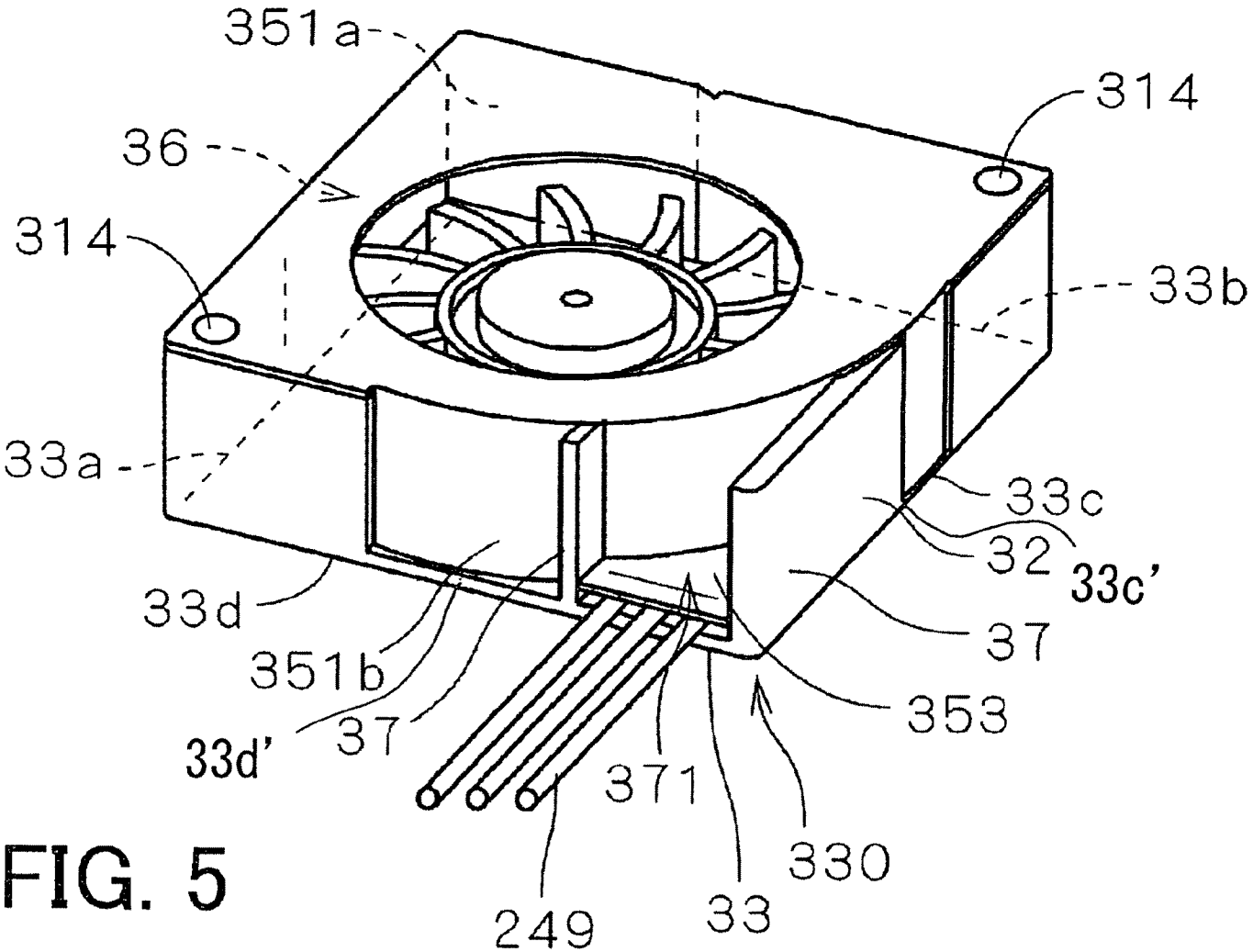
FIG. 5 is a perspective view of the centrifugal fan of FIG. 1, taken from a different direction from that of FIG. 3.

Details of the housing cover 31 are now described. FIG. 4 is a perspective view of the housing cover 31 of FIG. 3, taken from a different direction. FIG. 5 is a perspective view of the centrifugal fan 1 of FIG. 1, taken from the same direction as that of FIG. 4. As shown in FIGS. 3 and 4, the housing cover 31 includes an upper part 312 and two cover sidewalls 351. The upper part 312 has the opening 311 formed therein and opposed to the center region of the impeller 213. The opening 311 serves as the air inlet. The upper part of the housing cover 31 forms the upper face of the housing 3. The two cover sidewalls 351 stand vertically (i.e., in the axial direction) from the upper part 312 toward the bottom 33 of the housing body 32 on which the motor 2 is secured. The two sidewalls 351 are separately shown as cover sidewalls 351*a* and 351*b* in FIG. 4. One cover sidewall 351*a* serves as a wall defining the air outlet 36 (see FIG. 2) The other cover sidewall 351*b* is located diagonally to the air outlet 36.

The housing cover 31 can be formed by pressing a thin plate of stainless steel. Alternatively, the housing can be formed by cutting a metal member so as to achieve the sidewall having a desired thickness. However, cutting increases a manufacturing cost. As compared with cutting, pressing can form the housing inexpensively. It is preferable to employ the housing cover 31 in a compact centrifugal fan 1. More specifically, it is preferable that the bottom 33 of the housing body 32 have a size within a square having a side of approximately 20 mm (more preferably, a square having a side of approximately 15 mm).

It is also preferable that the thickness of the housing cover 31 be approximately 0.1 mm or more and approximately 0.6 mm or less for the following reasons. Usual fans are required to have a shock load of 100 G. Based on calculation of strength, in a case of the compact centrifugal fan 1, that requirement can be satisfied by setting the thickness of the housing cover 31 to 0.1 mm. Moreover, if the centrifugal fan 1 is mounted on mobile electronic equipment such as a PDA or a cellular phone, the centrifugal fan 1 should have a shock load of 5000 G, requiring the housing cover 31 to have a thickness of 0.2 mm. Thus, in the centrifugal fan 1 of this embodiment, the housing cover 31 is manufactured by pressing a thin plate having a thickness of 0.3 mm in consideration of a safety factor.

Other metal material than stainless steel may be used as the material for the housing cover 31, as long as the use of that material allows the housing cover 31 to be easily manufactured by pressing a thin plate. In addition, in a case where the thickness of the housing cover is 0.6 mm or more, the housing cover having a sufficient strength can be formed by resin molding. Therefore, the housing cover 31 formed of metal material preferably has a thickness of 0.6 mm or less.

As shown in FIG. 3, one body sidewall 352 of the housing body 32 is located between the cover sidewalls 351 and the other body sidewall 352 is located between one cover sidewall 351 (351*b* in FIG. 4) and the air outlet 36. The housing body 32 is formed of resin. The body sidewalls 352 have a thickness thicker than the housing cover 31 even at its thinnest portion, e.g., 0.6 mm.

The housing cover 31 is attached to the housing body 32 by inserting screws 314 into two holes 313 shown in FIG. 4 and screwing those screws 314 into the housing body 32 as shown in FIG. 5. However, the housing cover 31 may be secured to the housing body 32 in a different way, as described later.

Referring to FIG. 5, the cover sidewall 351*a*, which forms a part of the sidewall of the housing 3 opposed to the outer circumference of the impeller 213, is arranged from one end of the air outlet 36 to near a center of a side 33*b* of the bottom 33 of the housing body 32 over the substantially entire height of the housing 3 in the axial direction. Therefore, forming of the cover sidewall 351*a* by pressing a metal thin plate can easily enlarge the air-flow passage that gradually becomes wider toward the air outlet 36 in the cross section perpendicular to the rotation axis J1.

The other cover sidewall 351*b*, which forms another part of the sidewall of the housing 3, is arranged from near a center 33*d*' of a side 33*d* of the bottom 33 to near a center 33*c*' of a side 33*c* over the substantially entire height of the housing 3 in the axial direction. The side 33*d* is adjacent to a side 33*a* which forms a lower side of the air outlet 36, and the side 33*c* is opposed to the side 33*a*. Moreover, a portion of an outer peripheral edge of the bottom 33, which is the closest to an inner circumferential surface (shown with 350 in FIG. 1) of the sidewall of the housing 3, is just opposite to a bottom-side end face of the cover sidewall 351*b* in the axial direction, that is, is located at the substantially the same position as the bottom-side end face of the cover sidewall 351*b* in the radial direction. That portion of the outer peripheral edge of the bottom 33 corresponds to each of the centers of the sides 33*c* and 33*d*. Therefore, forming of the cover sidewall 351*b* from a thin metal plate can largely reduce the thickness of the sidewall of the housing 3 at that portion and can enlarge the passage easily. Accordingly, the size of the centrifugal fan 1 can be reduced relative to an area of a cross section of the passage which is perpendicular to the rotation axis J1.

Similarly, a bottom-side end face of the cover sidewall 351*a* is just opposite to another portion of the outer peripheral edge of the bottom 33, which is closest to the inner circumferential surface of the sidewall of the housing, in the axial direction, that is, is located at substantially the same portion as that portion of the outer peripheral edge of the bottom 33 in the radial direction. That portion of the outer peripheral edge of the bottom 33 corresponds to an air outlet side part of the side 33*b*. Therefore, the size reduction of the centrifugal fan 1 can be also achieved by forming the cover sidewall 351*a* from a thin metal plate.

The cover sidewalls 351 are formed by bending and drawing the housing cover 31 in this preferred embodiment. Therefore, rigidity of the housing cover 31 can be improved. In addition, the upper part 312 of the housing cover 31 as well as the cover sidewalls 351 is thin. Thus, the housing cover 31 described in this preferred embodiment is suitable for reduced-height centrifugal fans. In this preferred embodiment, the centrifugal fan 1 is designed to have a height of 5 mm.

The cover sidewalls 351 and the body sidewalls 352 are in contact with each other or overlap each other in a direction along the passage except for a region in which the air outlet 36 is formed. That is, the sidewall of the housing 3 is substantially continuously arranged to surround the outer circumference of the impeller 213 except for the region in which the air outlet 36 is formed. Therefore, leakage of air to the outside of the housing 3 can be prevented, suppressing lowering of air-blowing efficiency.

As shown in FIGS. 1, 4, and 5, the housing cover 31 further includes a holding portion 353 extending outward in the radial direction from a bottom-side portion of the cover sidewall 351*b* which is closest to the bottom 33 of the housing body 32. The holding portion 353 is opposed to an upper face of the bottom 33 near a corner 330 formed by the sides 33*c* and 33*d*, as shown in FIG. 5. An end portion 3531 of the holding portion 353 is bent so as to be located lower than the remaining portion of the holding portion 353 in the axial direction, as shown in FIGS. 1 and 4. This structure can surely catch a wire 249 connected to the motor 2 between the holding portion 353 and the bottom 33 of the housing body 32, and can therefore restrict movement of the wire 249 away from the bottom 33. Moreover, the holding portion 353 can hold the wire 249 in a relatively large area. Therefore, it is possible to prevent breakage of the wire 249 and improve reliability of the centrifugal fan 1.

The housing body 32 further includes two walls 37 extending from the bottom 33 in the axial direction towards the upper part of the housing cover. The walls 37 are arranged on both sides of the holding portion 353 in a direction parallel to the side 33*d*, as shown in FIG. 5. Those walls 37 define a groove-like concave portion 371 therebetween, in which the wires 249 are held between the cover sidewall 351*b* and the bottom 33 of the housing body 32. Therefore, the walls 37 can surely restrict horizontal movement of the wires 249 (i.e., movement in a direction parallel to the bottom 33). Moreover, a buffer or the like for preventing damages of the wires is not necessary. Therefore, the number of required components of the centrifugal fan 1 can be reduced.

Furthermore, the following advantageous effect is also obtained. Conventionally, the circuit board was first attached to the inside of the housing body (to the upper face of the bottom of the housing body), and thereafter the wires were soldered on the circuit board from a lower-face side of the bottom and were secured along a groove or a rib formed in/on the lower face of the bottom. On the other hand, according to this preferred embodiment, the cover sidewalls 351 are provided in the housing cover 31 in the centrifugal fan 1. Therefore, it is possible to attach the circuit board 24, on which the wires 249 are soldered in advance, to the housing body 32, then attach the housing cover 31, and finally secure the wires 249. Thus, the centrifugal fan 1 can be easily assembled.

Figure 6:
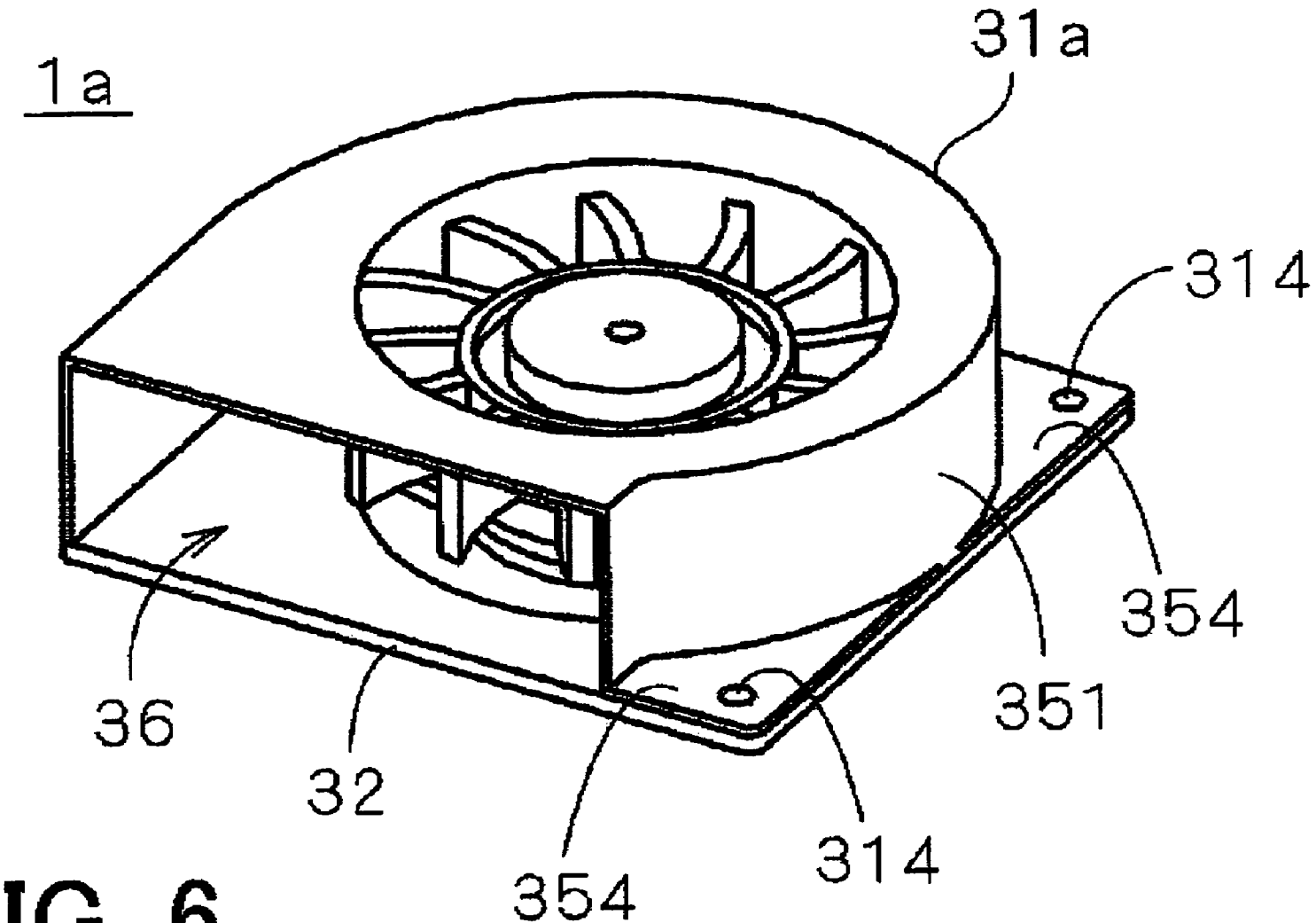
FIG. 6 is a perspective view of a centrifugal fan according to a second preferred embodiment of the present invention.

FIG. 6 is a perspective view of a centrifugal fan 1*a* according to a second preferred embodiment of the present invention. The centrifugal fan 1*a* does not include the body sidewall of the housing body 32. Instead, the cover sidewall 351 of a housing cover 31*a* is formed over the entire circumferential length of the air-flow passage. In other words, the cover sidewall 351 forms the entire sidewall of the housing 3. Therefore, the entire sidewall can be made thin. An approximately plate-like housing body 32 shown in FIG. 6 may be formed by pressing a steel plate. Please note that the wires are omitted in FIG. 6 (the same is applied to perspective views of centrifugal fans that will be referred to later).

In this preferred embodiment, flanges 354 are provided as parts of the housing cover 31*a*. The flanges 354 extend radially outward from a bottom-side portion, i.e., a lower end, of the cover sidewall 351 and are opposed to three corners of the housing body 32 in the vertical direction, respectively. FIG. 6 shows two of the flanges 354 only. The flanges 354 are screwed down on the housing body 32 with screws 314, respectively. In this manner, the housing cover 31*a* is secured on the housing body 32.

Since no sidewall is provided in the housing body 32 in the centrifugal fan 1*a*, the overall shape of the centrifugal fan 1*a* can be made simple. In addition, since the cover sidewall 351 forming the entire inner side face of the housing 3 can be manufactured by pressing a thin plate, an air-flow passage having a large area of a cross section perpendicular to the rotation axis can be ensured while the size of the centrifugal fan 1*a* is reduced.

Figure 7:
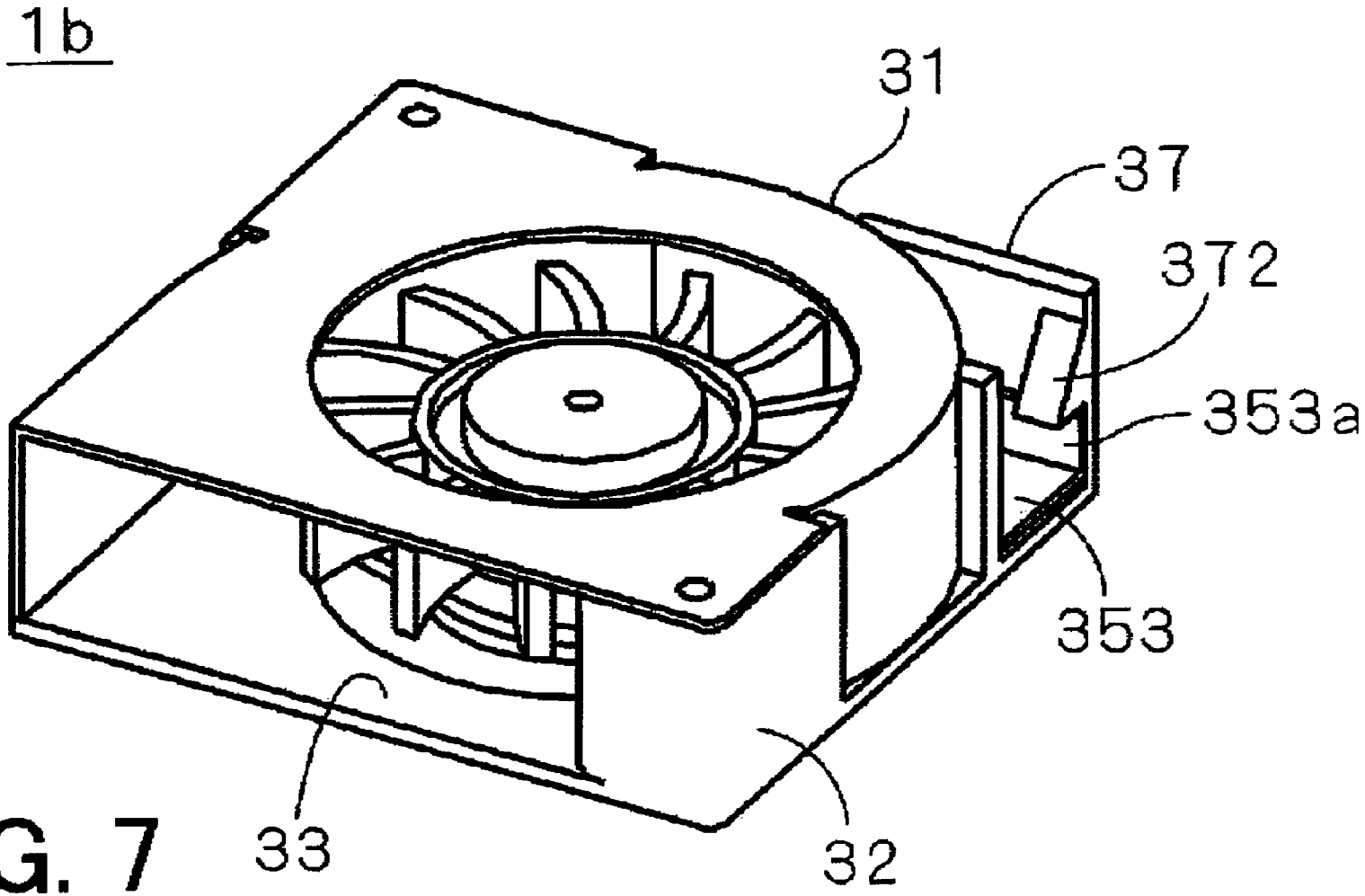
FIG. 7 is a perspective view of a centrifugal fan according to a third preferred embodiment of the present invention.

FIG. 7 is a perspective view of a centrifugal fan 1*b* according to a third preferred embodiment of the present invention. Except for the shape of the holding portion 353 and the shape of the walls 37 adjacent to the holding portion 353, the structure of the centrifugal fan 1*b* is the same as that of the centrifugal fan 1 of the first embodiment. Therefore, detailed description of parts of the centrifugal fan 1*b* other than the holding portion 353 and walls 37 is omitted.

In the centrifugal fan 1*b*, an engagement portion 353*a* opposed to the walls 37 is formed by bending a portion of the holding portion 353 away from the bottom 33 of the housing body 32 (i.e., upward). The engagement portion 353*a* extends vertically, i.e., in the axial direction to be adjacent to one of the walls 37 arranged on one side of the bottom 33. That wall 37 is provided with a claw-like projection 372 integral therewith as one body. An upper end of the engagement portion 353*a* comes into contact with a lower face of the projection 372. This engagement of the engagement portion 353*a* with the projection 372 restricts movement of the holding portion 353 away from the bottom 33. When the housing cover 31 is mounted on the housing body 32, the engagement portion 353*a* slides on the projection 372 while deforming elastically. The shape of the engagement portion 353*a* returns to its original shape below the projection 372.

Moreover, since the engagement portion 353*a* is provided in the holding portion 353, it is possible to prevent large deformation of the holding portion 353 caused by a force applied from the wires 249 (see FIG. 5) during handling of the centrifugal fan 1*b*.

Figure 8:
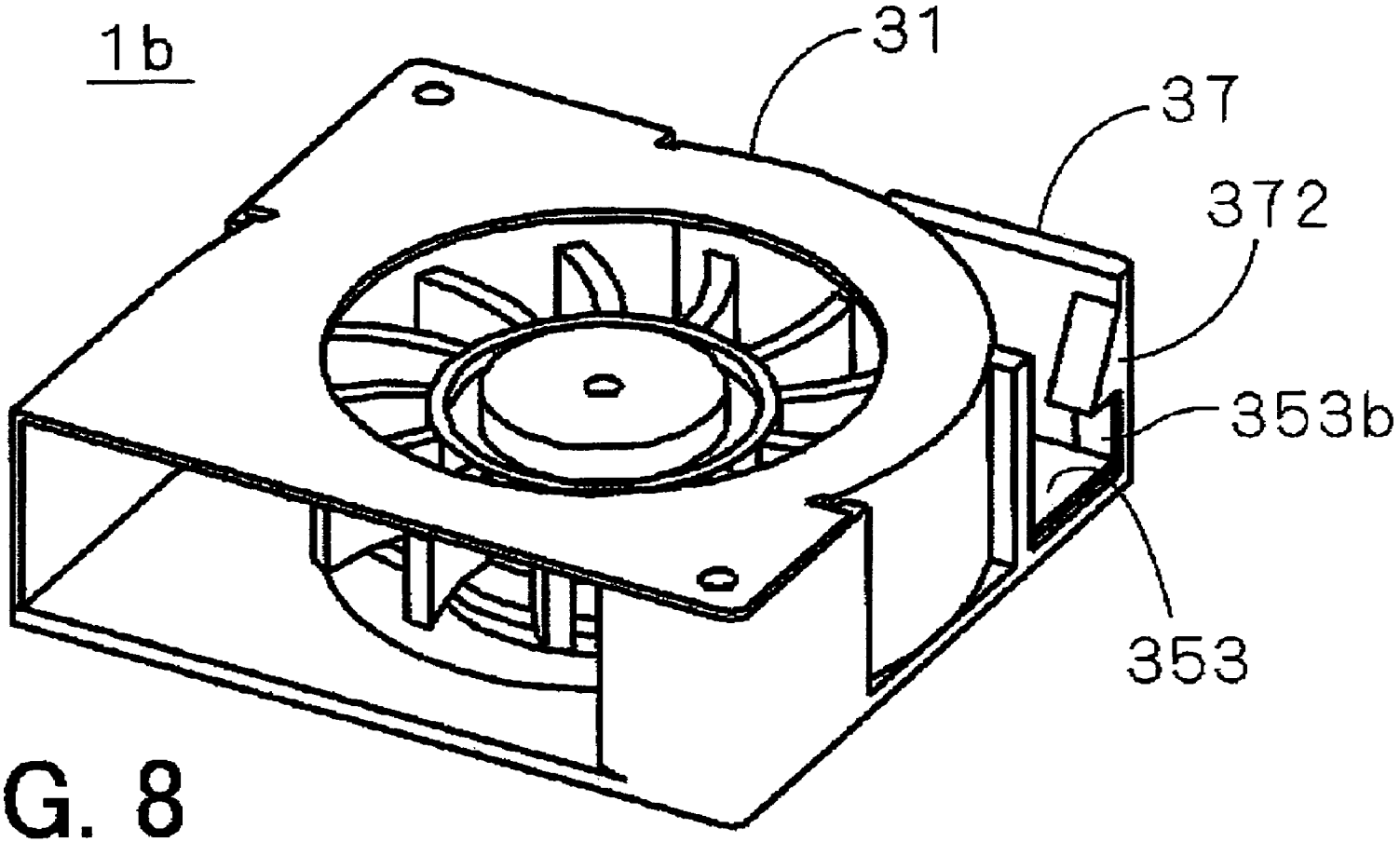
FIG. 8 is a perspective view of an exemplary modification of the centrifugal fan of the third preferred embodiment.
Figure 9:
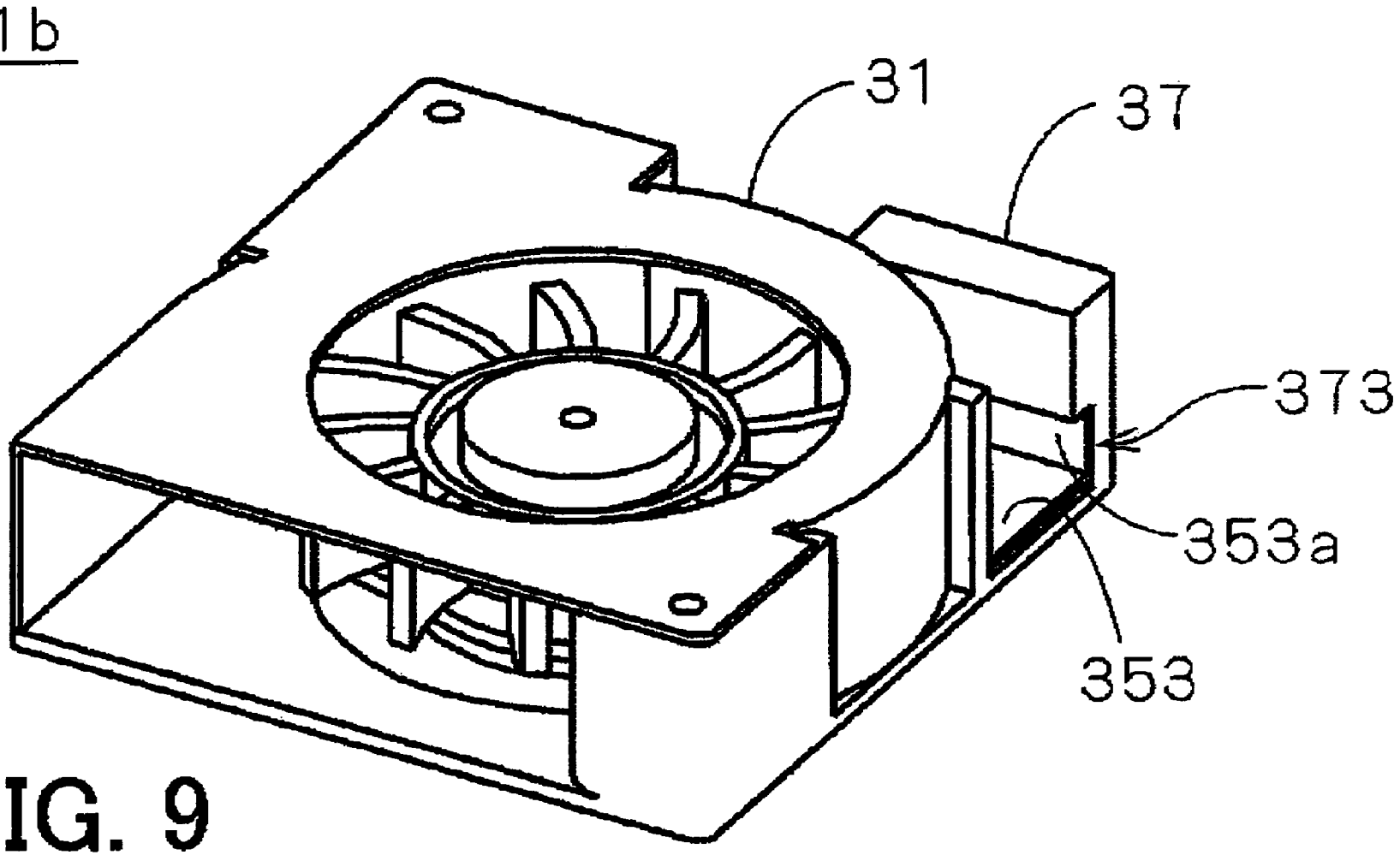
FIG. 9 is a perspective view of another exemplary modification of the centrifugal fan of the third preferred embodiment.
Figure 10:
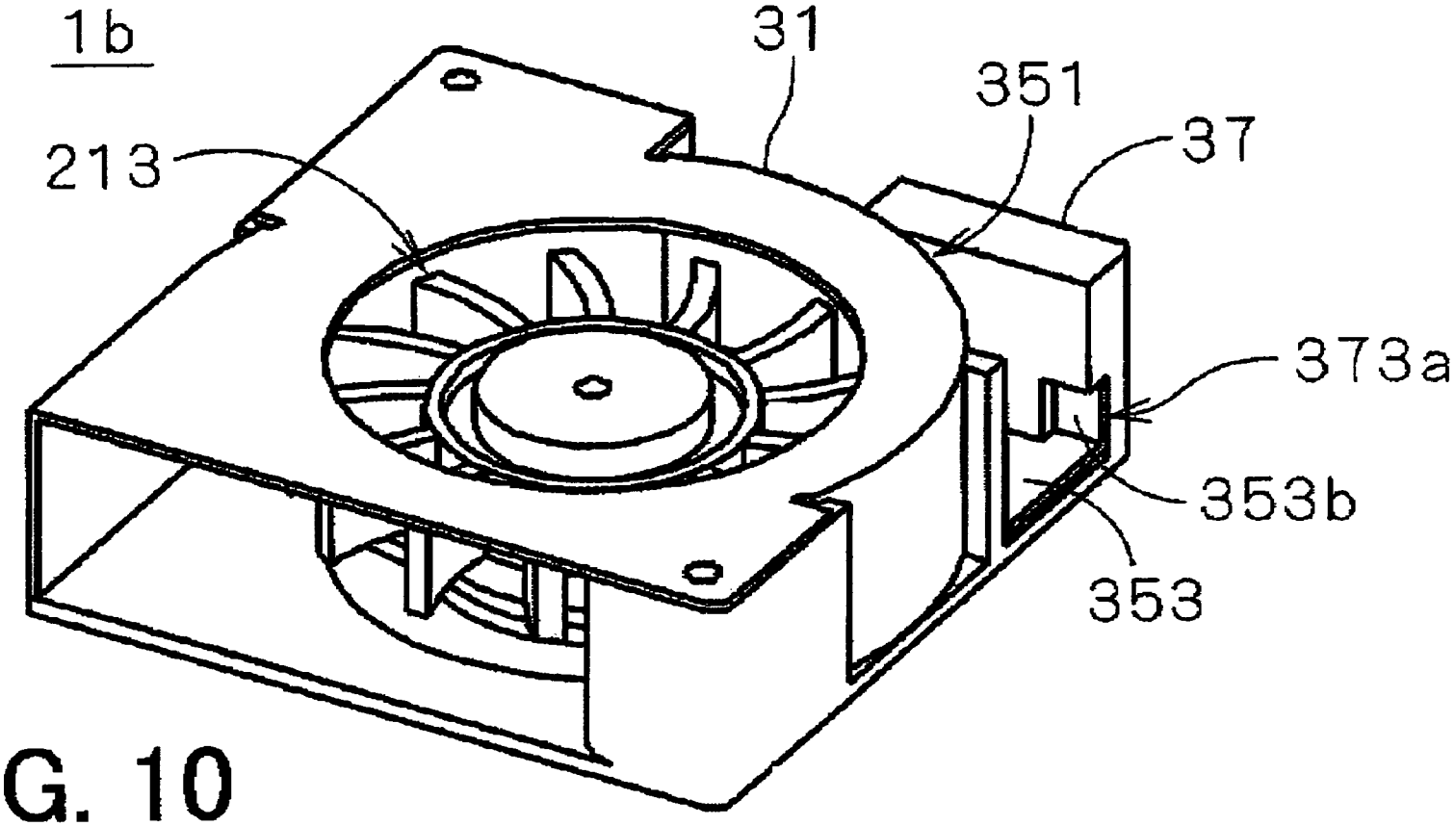
FIG. 10 is a perspective view of still another exemplary modification of the centrifugal fan of the third preferred embodiment.

FIGS. 8 to 10 are modified examples of the engagement of the holding portion 353 of the housing cover 31 with the associated one of the walls 37 of the housing body 32 of the centrifugal fan 1*b*. In the centrifugal fan 1*b* shown in FIG. 8, the same projection 372 as that shown in FIG. 7 is formed on the wall 37 arranged on one side of the bottom 33. However, an engagement portion 353*b*, with which the projection 372 is to engage, is formed as a part of the holding portion 353 so as to only have a corresponding width to that of the projection 372 in a direction of the side of the bottom 33 on which the associated wall 37 is arranged. Therefore, the size of the engagement portion 353*b* can be made minimum.

In the centrifugal fan 1*b* shown in FIG. 9, the holding portion 353 includes the same engagement portion 353*a* as that shown in FIG. 7. The engagement portion 353*a* is fitted into a groove-like concave portion 373 formed in the associated wall 37, so that an upper end of the engagement portion

353*a* comes into contact with an upper surface of the concave portion 373 opposed thereto. As described above, the wall 37 may be provided with a structure that can be considered as a concave portion for engaging with the engagement portion of the holding portion.

In the centrifugal fan 1*b* shown in FIG. 10, the same engagement portion 353*b* as that shown in FIG. 8 is formed in the holding portion 353, and a concave portion 373*a* into which the engagement portion 353*b* is just fitted is formed on the wall 37. When the engagement portion 353*b* is fitted into the concave portion 373*a*, an upper end and one side of the engagement portion 353*b* are in contact with or opposed to inner side faces of the concave portion 373*a*. Thus, upward movement of the holding portion 353 and movement thereof toward the impeller 213 can be restricted. Accordingly, more stable positioning of the holding portion 353 can be achieved.

Figure 11:
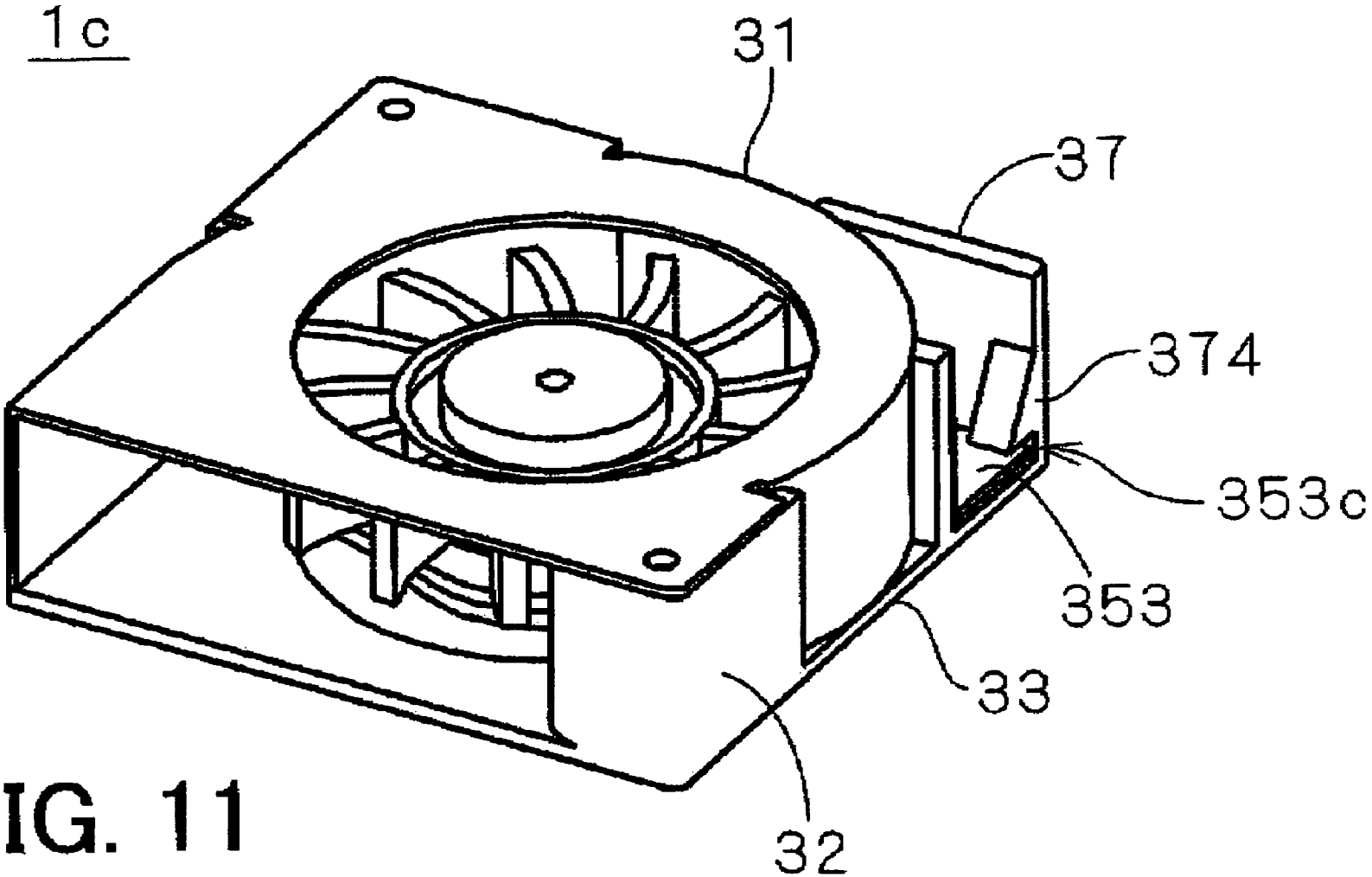
FIG. 11 shows a perspective view of a centrifugal fan according to a fourth preferred embodiment of the present invention.

FIG. 11 is a perspective view of a centrifugal fan 1*c* according to a fourth preferred embodiment of the present invention. The centrifugal fan 1*c* includes the same housing cover 31 as shown in FIG. 2. A claw-like projection 374 is provided on the wall 37 arranged on one side of the bottom 33 of the housing body 32. When an end part 353*c* of the holding portion 353 on that wall 37 side is inserted between the bottom 33 of the housing body 32 and the projection 374, the holding portion 353 engages with the wall 37, thereby restricting movement of the holding portion 353 away from the bottom 33 of the housing body 32.

In the centrifugal fan 1*c*, a force applied to the holding portion 353 in order to engage the holding portion 353 with the wall 37 is larger than that in the centrifugal fan 1*b* shown in FIG. 7. However, in a case where the centrifugal fan 1*c* is compact, this causes no problem because the wall 37 can be flexibly deformed. Moreover, the shape of the holding portion 353 can be made simple in the centrifugal fan 1*c*. The structures in which the engagement portion is formed by bending a part of the holding portion 353 shown in FIGS. 7 to 10 are more advantageous because the holding portion 353 can be secured more tightly in those structures than in the structure shown in FIG. 11. However, for compact centrifugal fans, the structure shown in FIG. 11 is acceptable.

Figure 12:
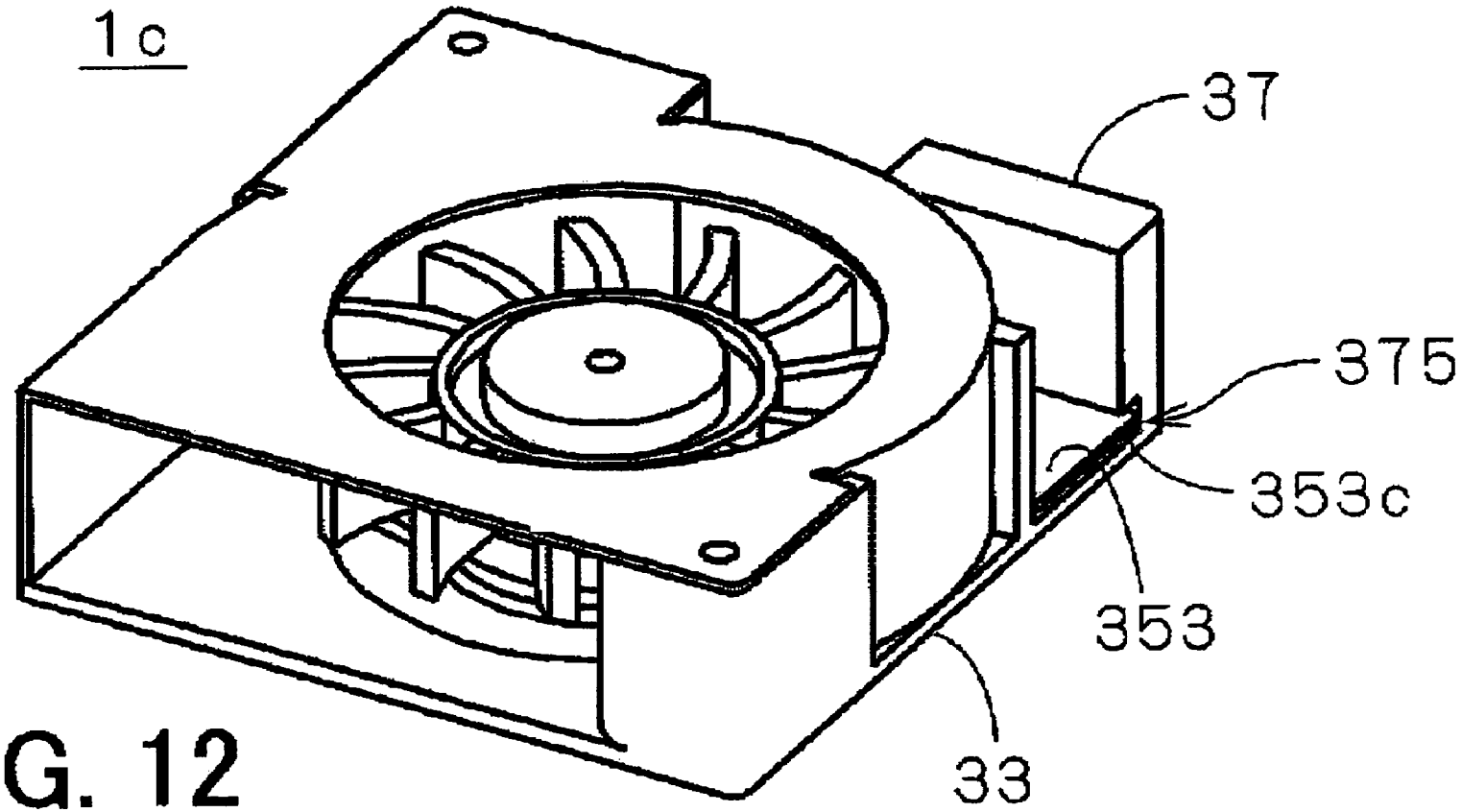
FIG. 12 is a perspective view of an exemplary modification of the centrifugal fan of the fourth preferred embodiment.

FIG. 12 is a perspective view of the centrifugal fan 1*c* in which the projection 374 shown in FIG. 11 is replaced with a groove-like concave portion 375 formed along one side of the bottom 33 between the wall 37 and the bottom 33. Engagement of the end part 353*c* of the holding portion 353 with the concave portion 375 restricts movement of the holding portion 353 away from the bottom 33 of the housing body 32, as shown in FIG. 12.

Figure 13:
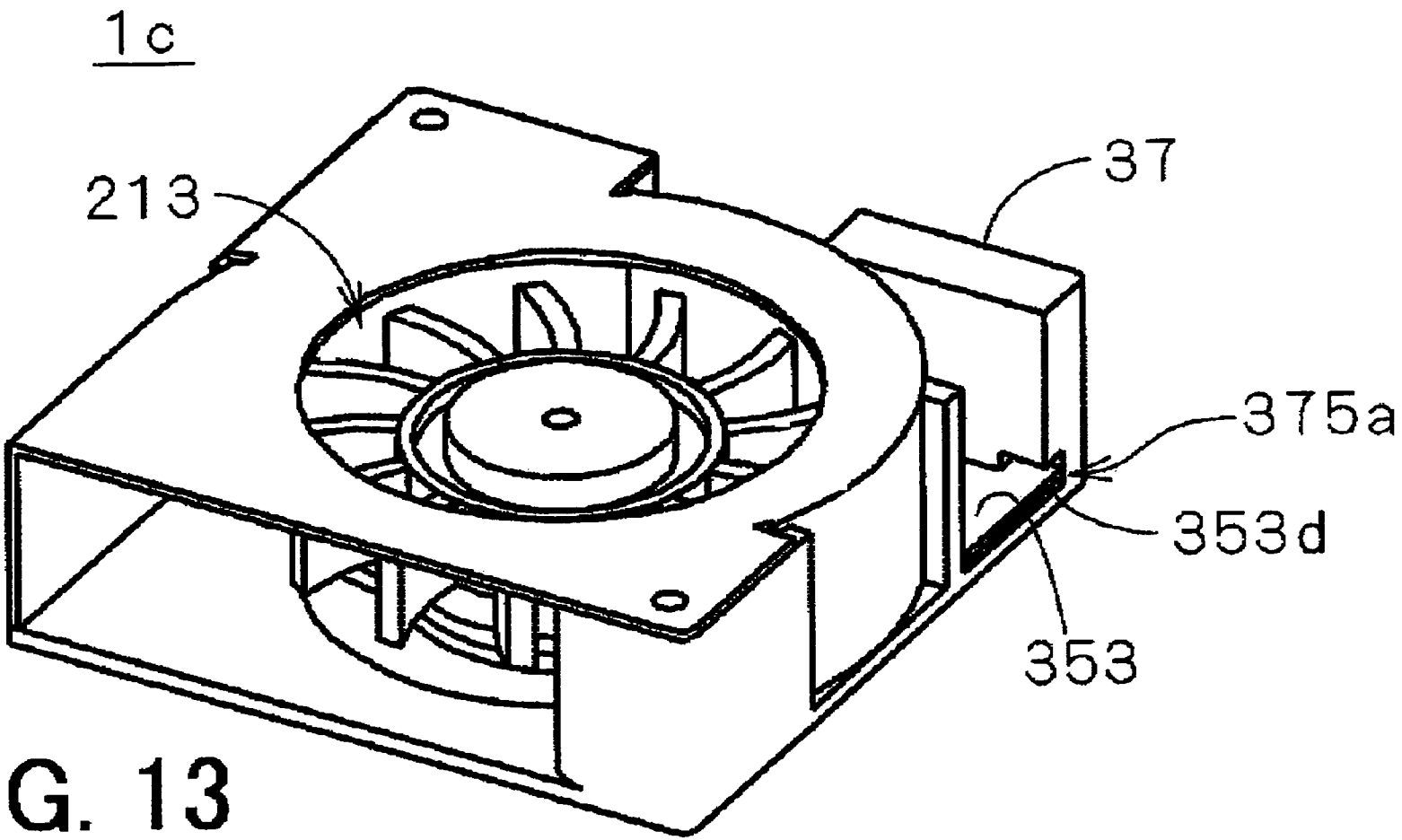
FIG. 13 is a perspective view of another exemplary modification of the centrifugal fan of the fourth preferred embodiment.

FIG. 13 illustrates the centrifugal fan 1*c* in which an end of the holding portion 353 on the wall 37 side partly projects toward the wall 37 to form a projection 353*d*. The wall 37 includes a groove-like concave portion 375*a* for receiving the projection 353*d*. The groove-like concave portion 375*a* has a corresponding size to that of the projection 353*d*. When the projection 353*d* is fitted into the concave portion 375*a*, upward movement of the holding portion 353 and movement thereof toward the impeller 213 are restricted in the same manner as that shown in FIG. 10. Therefore, positioning of the holding portion 353 can be made more stable.

Figure 14:
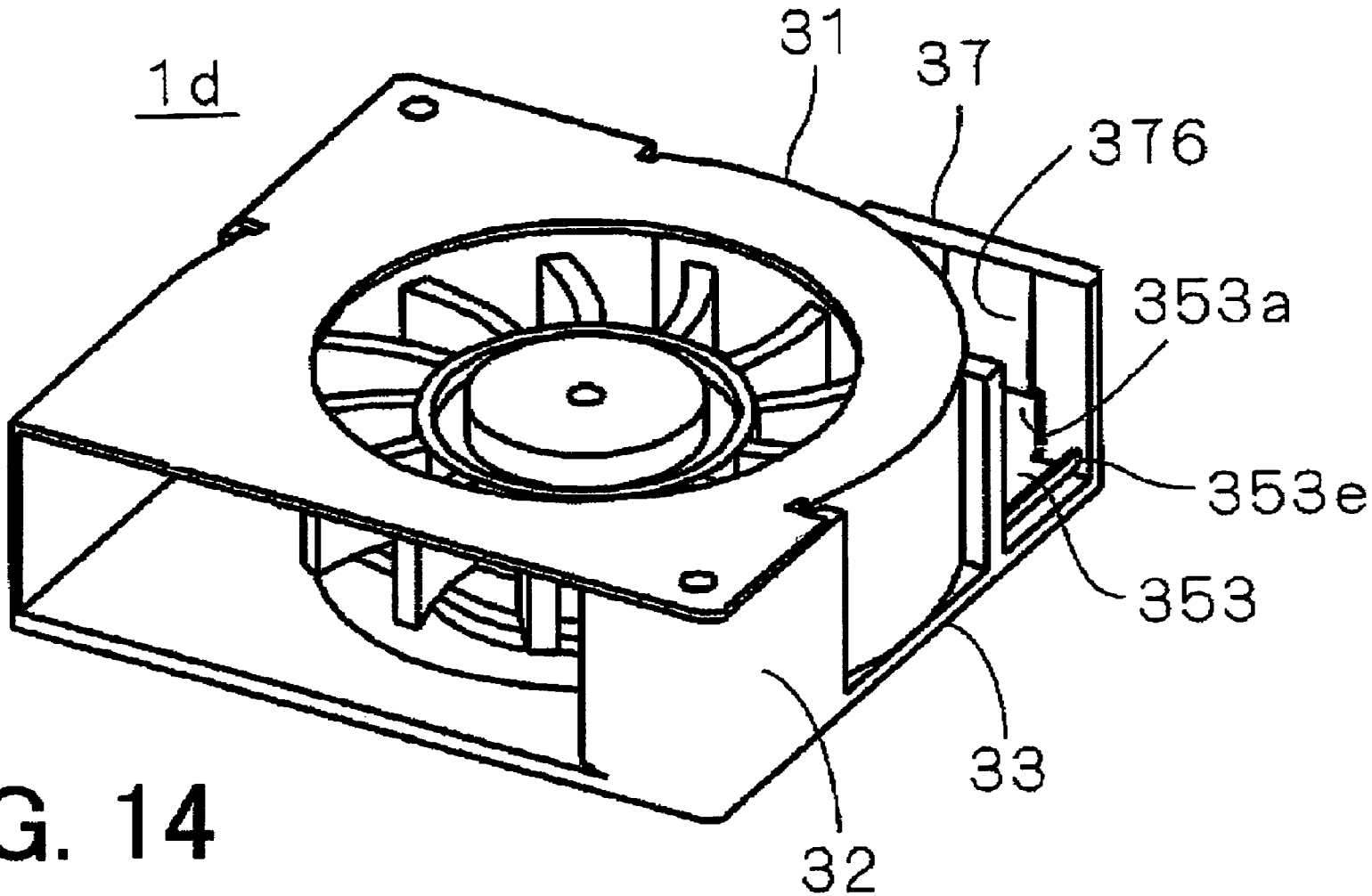
FIG. 14 is a perspective view of a centrifugal fan according to a fifth preferred embodiment of the present invention.

FIG. 14 is a perspective view of a centrifugal fan 1*d* according to a fifth preferred embodiment of the present invention. In this centrifugal fan 1*d*, the holding portion 353 of the housing cover 31 includes the engagement portion 353*a* formed by bending an end part of the holding portion 353 on one wall 37 side away from the bottom 33 in the same manner as that shown in FIG. 7. That wall 37 is arranged on one side of the bottom 33 of the housing body 32 and includes a low projection 376 integral therewith. The low projection 376 has a height from the wall 37 which is set to allow the low projection 376 to come into contact with an upper end of the engagement portion 353*a*.

The holding portion 353 further includes a wire guide portion 353*e*. The wire guide portion 353*e* is formed by smoothly bending an end part of the holding portion 353 from which the wires 249 (see FIG. 5, not shown in FIG. 14) are drawn out, in a direction away from the bottom 33 of the housing body 32. The wire guide portion 353*e* may have a shape obtained by bending that end part of the holding portion 353 obliquely upward.

The wire guide portion 353*e* allows the wires 249 between the bottom 33 of the housing body 32 and the holding portion 353 to be smoothly bent (i.e., be bent with a large radius of curvature or at several bending points that are distributed) even if the wires 249 are pulled away from the bottom 33 in the outside of the centrifugal fan 1*d*. Therefore, damages of the wires 249 can be prevented and the reliability of the centrifugal fan 1*d* can be improved.

Figure 15:
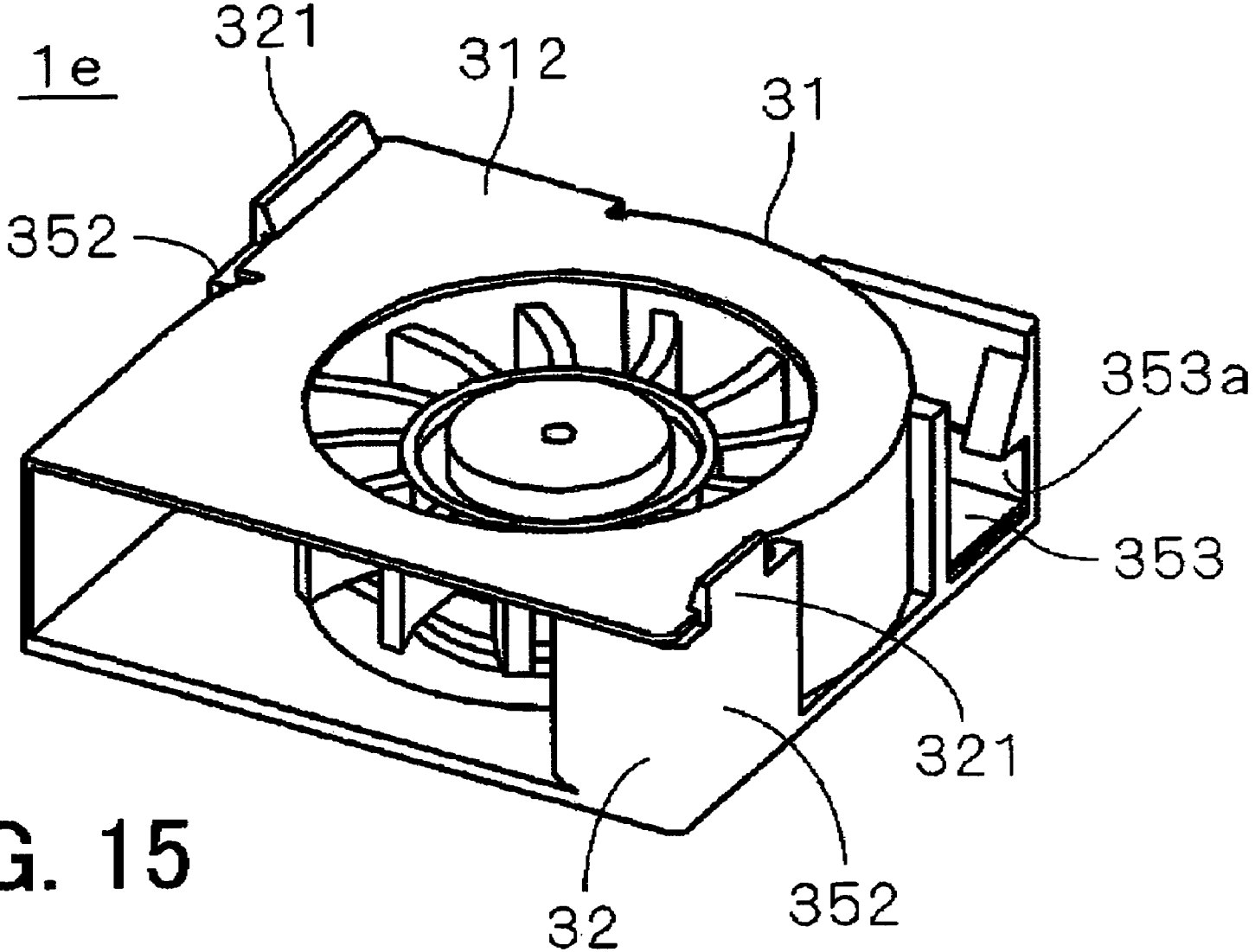
FIG. 15 is a perspective view of a centrifugal fan according to a sixth preferred embodiment of the present invention.

FIG. 15 is a perspective view of a centrifugal fan 1*e* according to a sixth preferred embodiment of the present invention. Except for a manner of attachment of the housing cover 31 to the housing body 32, the centrifugal fan 1*e* is the same as the centrifugal fan 1*b* shown in FIG. 7.

In the centrifugal fan 1*e*, no screwing hole is provided in the housing cover 31. Instead, two claw-like fitting portions 321 are provided on the body sidewalls 352 of the housing body 32, as shown in FIG. 15. When an edge of the upper part 312 of the housing cover 31 is fitted with those fitting portions 321, the housing cover 31 is secured to the housing body 32. The fitting portions 321 and the housing body 32 are formed by resin molding as one body.

The use of this method for securing the housing cover 31 to the housing body 32 can reduce the size of the housing cover 31 in a development view, as compared with a case where the claw-like portion is provided in the housing cover 31. Thus, efficiency of using a plate for manufacturing of the housing cover 31 can be improved and therefore a manufacturing cost can be reduced. Moreover, since the fitting portions 321 and the engagement portion 353*a* of the holding portion 353 are used, it is possible to assemble the housing 3 extremely easily, as compared with a case where the housing 3 is formed by screwing the housing cover 31 onto the housing body 32.

Figure 16:
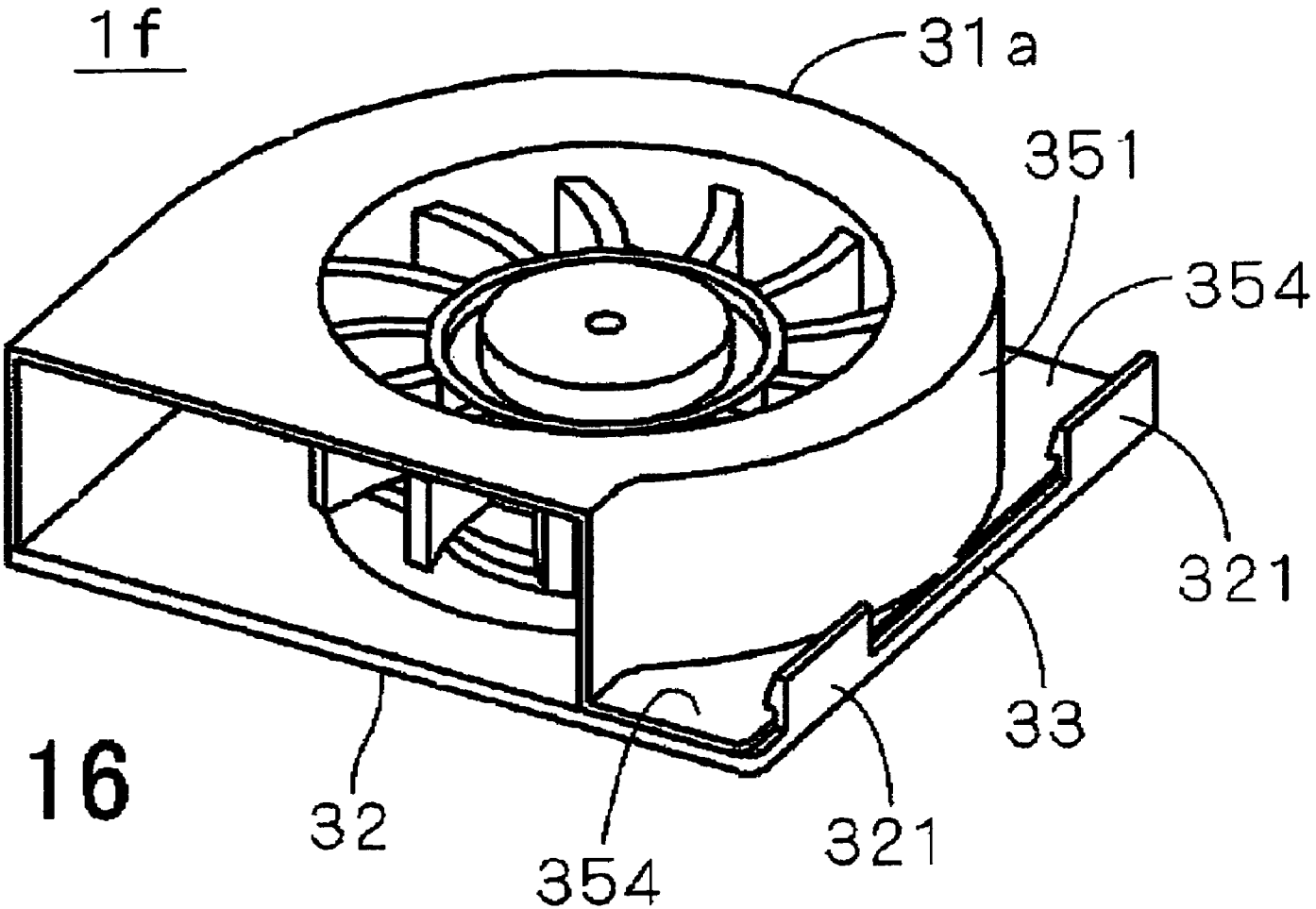
FIG. 16 is a perspective view of an exemplary modification of the centrifugal fan of the sixth preferred embodiment.

FIG. 16 illustrates a centrifugal fan if according to a seventh preferred embodiment of the present invention. In the centrifugal fan if, the housing cover 31*a* of the centrifugal fan 1*a* shown in FIG. 6 is attached to the housing body 32 in the same manner as shown in FIG. 15, and claw-like fitting portions 321 are provided on the bottom 33 of the housing body 32. When edges of the flanges 354 extending radially outward from the bottom-side portion of the cover sidewall 351 of the housing cover 31*a* are fitted with the fitting portions 321, the housing cover 31*a* is secured to the housing body 32.

As described above, the fitting portion 321 of the housing body 32 may be provided at any position, as long as the edge of one face of the housing cover 31 perpendicular to the rotation axis J1 (see FIG. 2) of the impeller 213 is fitted with that fitting portion 321. In this case, the housing cover 31 can be easily secured to the housing body 32 without making the shape of the housing cover 31 complicated.

The exemplary preferred embodiments of the present invention have been described in the above. However, the present invention is not limited thereto, but can be modified in various ways.

Figure 17:
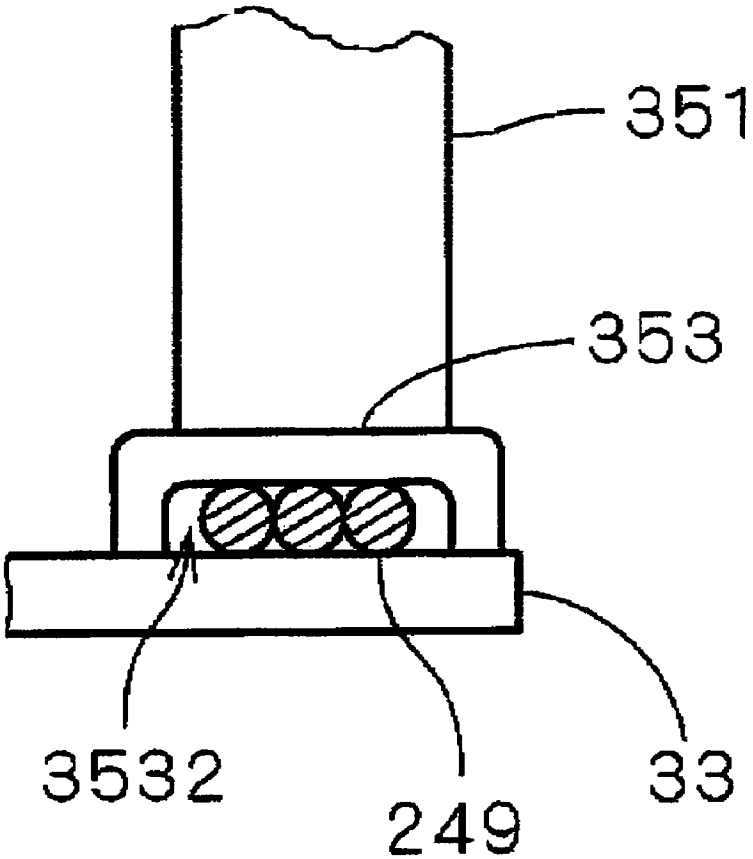
FIG. 17 illustrates an exemplary holding portion.

In the structure shown in FIG. 5, horizontal movement of the wires 249 is restricted by arranging the wires 249 in the groove-like concave portion 371 between the walls 37. However, such a concave portion for allowing the wires 249 to be arranged therein may be provided in the holding portion 353, as shown in FIG. 17, for example. In the holding portion 353 shown in FIG. 17, an end part of the holding portion 353 is bent downward on both sides of the wires 249, so that a groove-like concave portion 3532 (which is concave upward) in which the wires 249 are to be arranged is formed. This structure can restrict the horizontal movement of the wires 249 arranged between the holding portion 353 and the bottom 33 of the housing body 32.

In the structures shown in FIGS. 7 to 10, it is not necessary to bend the holding portion 353 perpendicularly to form the engagement portions 353*a* and 353*b*. For example, the holding portion 353 may be curved. In this case, the holding portion 353 can be more easily caught relative to the wall 37.

The wall 37 does not necessarily have the same height from the bottom 33 as the cover sidewall 351. For example, the wall 37 may be a lower projection, as long as it can catch the holding portion 353.

In the above embodiments, the cover sidewall 351 is provided at least at a position on the edge of the bottom 33 of the housing body 32 closest to the inner circumferential surface of the sidewall of the housing 3. However, the cover sidewall 351 may be arranged at any other position, as long as at least a part of the sidewall of the housing 3 is formed by the cover sidewall 351. In this case, it is possible to easily make at least that part of the sidewall of the housing 3 thinner and easily enlarge at least a corresponding part of the air-flow passage.

Figure 18:
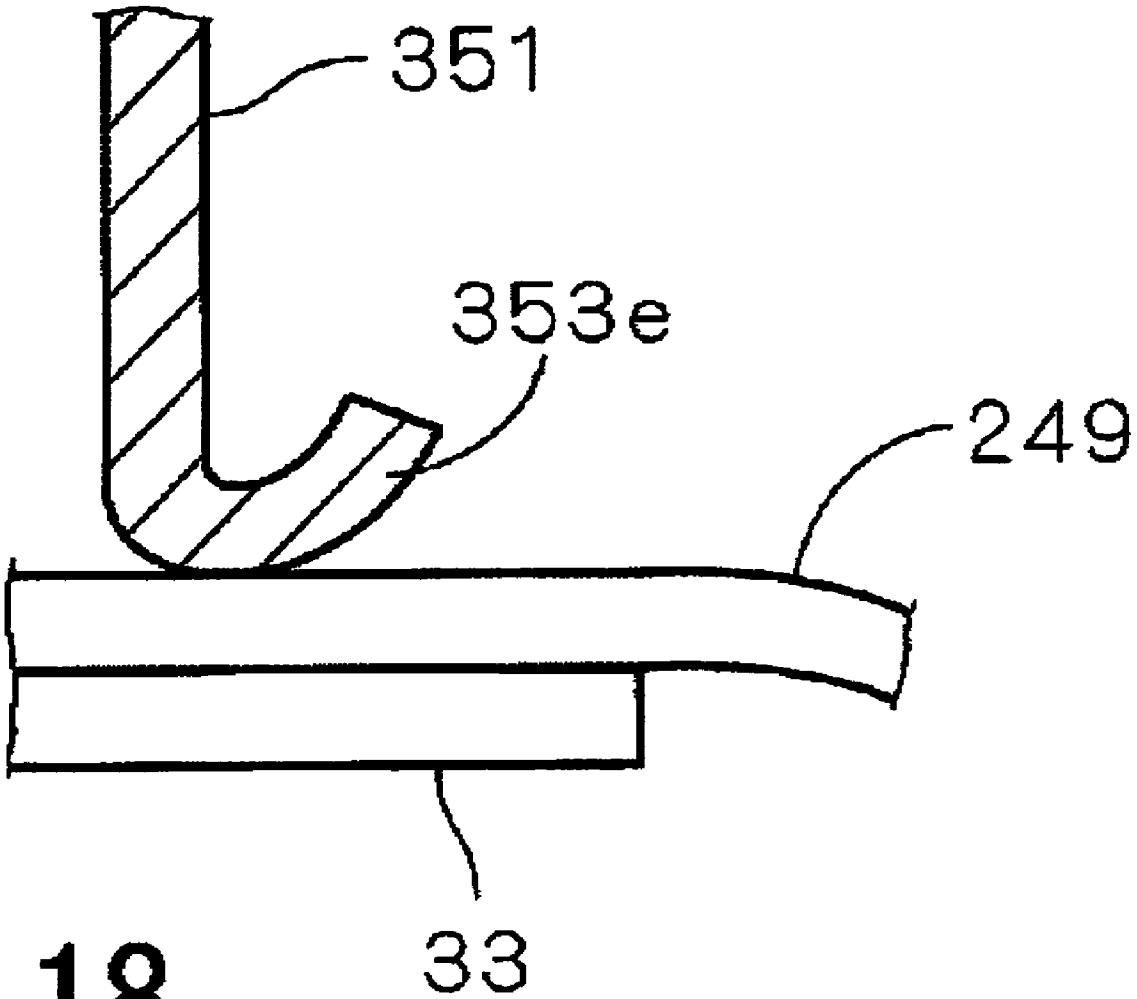
FIG. 18 illustrates an exemplary cover sidewall of the housing cover.

Moreover, the holding portion 353 may be omitted so as to arrange the wires 249 between the bottom 33 of the housing body 32 and the bottom side end of the cover sidewall 351, as shown in FIG. 18. In this case, the bottom side end of the cover sidewall 351 and the bottom 33 restrict the movement of the wires 249 away from the bottom 33. In other words, a lower end of the cover sidewall 351 may serve as the aforementioned holding portion. In addition, the wire guide portion 353*e* may be formed directly at the lower end of the cover sidewall 351, i.e., by bending a portion of the cover sidewall 351 near its lower end away from the bottom 33 in such a manner that the wire guide portion 353*e* extends radially outward from the lower end of the cover sidewall 351, as shown in FIG. 18.

The wires 249 are not limited to code-like wires. Alternatively, an FPC (Flexible printed circuit board) may be used.

Figure 19:
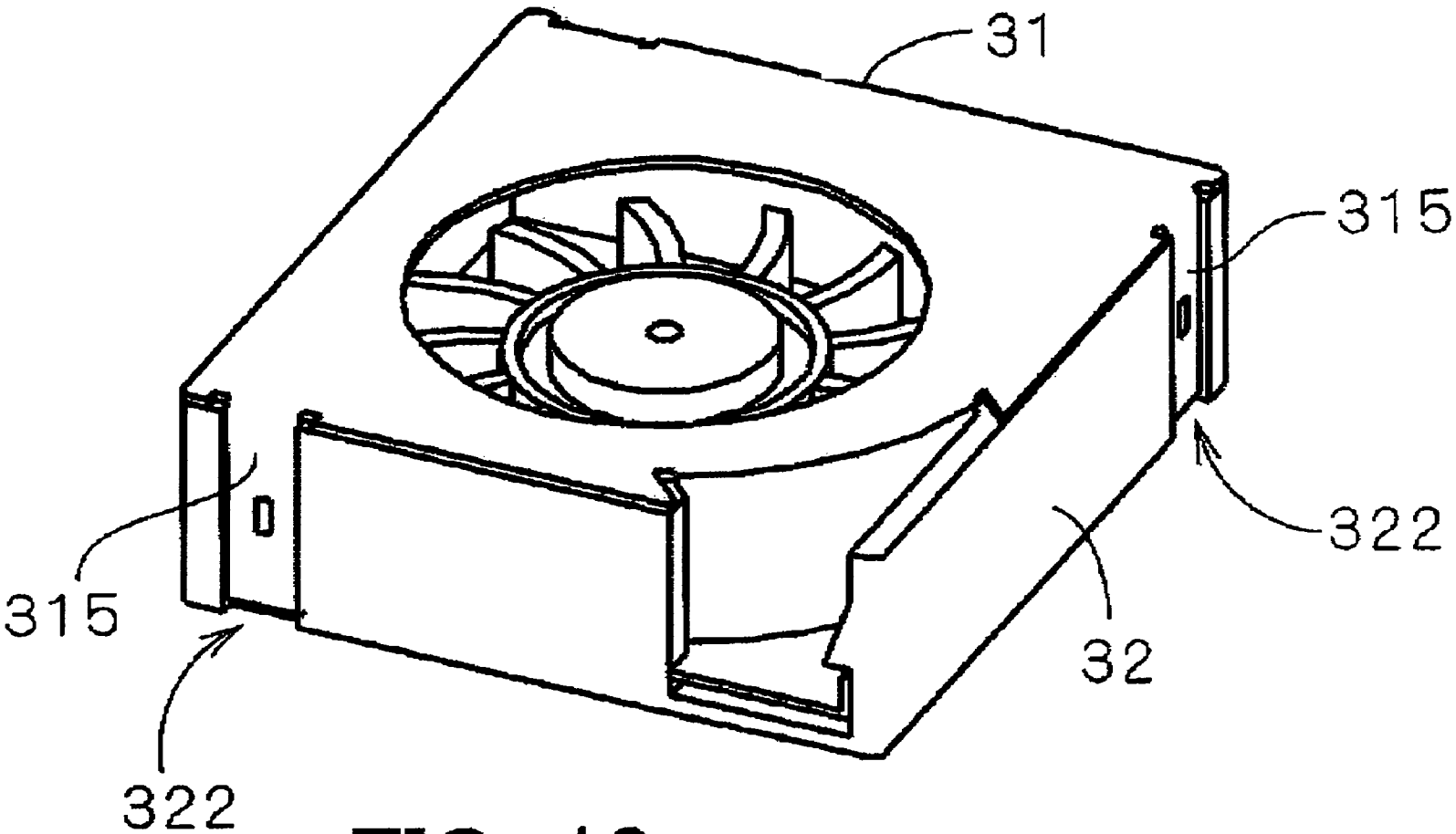
FIG. 19 is a perspective view of a centrifugal fan according to a seventh preferred embodiment of the present invention.

The method for securing the housing cover 31 to the housing body 32 is not limited to the methods described in the above. For example, the housing cover 31 may be secured to the housing body 32 by forming a hook 315 extending downward in a peripheral region of the housing cover 31, and fitting the hook 315 into a groove 322 formed in the sidewall of the housing body 32 to be caught (i.e., by snap-fitting), as shown in FIG. 19. Moreover, a hole may be provided in the hook 315 and a projection may be provided in the groove 322, so that the hole and the projection allow the hook 315 to be caught. Alternatively, a projection may be formed on the hook 315 to project toward the groove 322 and a recess may be formed in the groove 322. The securing method shown in FIG. 19 can prevent a positional shift of the housing cover 31 by using elasticity of the housing cover 31.

As described above, according to the present invention, it is possible to easily make at least a part of a sidewall of a housing thinner in a centrifugal fan, thus easily enlarging an air-flow passage formed around an impeller. Moreover, lowering of air-blowing efficiency can be suppressed. In addition, according to the present invention, size reduction of the centrifugal fan can be achieved.

In addition, movement of wires away from a bottom of the housing can be restricted by providing a holding portion having a simple structure. In a case where a concave portion in which the wires are to be arranged is provided, movement of the wires in a direction along the bottom can be also restricted. Furthermore, by providing a wire guide portion in the holding portion, it is possible to prevent damages of the wires and improve reliability of the centrifugal fan.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A centrifugal fan comprising:

a motor having an impeller;

a housing accommodating the motor and having a sidewall at least partially surrounding an outer circumference of the impeller, the housing including an air inlet opposed to a central portion of the impeller and an air outlet opposed to the outer circumference of the impeller, wherein the housing includes a housing body having a bottom on which the motor is secured and a housing cover in which the air inlet is formed, the housing cover including an upper part and a cover sidewall that extends from the upper part toward the bottom of the housing body and forms at least a part of the sidewall of the housing, and the housing cover is a pressed metal member, wherein a lead wire connected to the motor is arranged between the cover sidewall of the housing cover and the bottom of the housing body, wherein the housing cover includes a wire guide portion extending radially outward from a bottom-side portion of the cover sidewall and being bent away from the bottom of the housing body.

2. The centrifugal fan according to claim 1, wherein the sidewall of the housing is substantially continuously arranged along the outer circumference of the impeller except for a region in which the air outlet is formed.

3. The centrifugal fan according to claim 1, wherein the cover sidewall of the housing cover forms the entire sidewall of the housing.

4. The centrifugal fan according to claim 1, wherein the housing cover further includes a holding portion extending from a bottom-side portion of the cover sidewall, the holding portion is adjacent to a corner of the bottom of the housing body, and the lead wire is arranged between the holding portion and the bottom of the housing body.

5. The centrifugal fan according to claim 4, wherein one of the cover sidewall of the housing cover and the bottom of the housing body has a groove-like concave portion in which the lead wire is arranged.

6. The centrifugal fan according to claim 4, wherein an end part of the holding portion is bent away from the bottom of the housing body to form a wire guide portion.

7. The centrifugal fan according to claim 4, wherein the housing body includes a wall arranged on a side of the bottom of the housing body along the side, the wall arranged along an edge of the holding portion, and engagement of the edge of the holding portion with the wall restricts movement of the holding portion away from the bottom.

8. The centrifugal fan according to claim 7, wherein an engagement feature is formed on the wall, the engagement feature being concave or convex, and an end part of the holding portion including the edge is bent away from the bottom of the housing body to form an engagement portion capable of coming into contact with the engagement feature of the wall at its top end.

9. The centrifugal fan according to claim 1, wherein a bottom-side portion of the cover sidewall is just opposite to a portion of an outer peripheral edge of the bottom of the housing body closest to an inner circumferential surface of the sidewall of the housing in a direction parallel to a rotation axis.

10. The centrifugal fan according to claim 1, wherein a portion of an outer peripheral edge of the bottom of the housing body, which is closest to an inner circumferential surface of the sidewall of the housing, is located at substantially the same portion in a radial direction perpendicular to a rotation axis as a bottom-side portion of the cover sidewall.

11. The centrifugal fan according to claim 1, wherein a thickness of the housing cover is 0.1 mm or more and 0.6 mm or less.

12. The centrifugal fan according to claim 1, wherein the bottom of the housing body has a size within a square having a side of 20 mm.

13. A centrifugal fan comprising:

a motor having an impeller;

a housing accommodating the motor and having a sidewall at least partially surrounding an outer circumference of the impeller, the housing including an air inlet opposed to a central portion of the impeller and an air outlet opposed to the outer circumference of the impeller, wherein the housing includes a housing body having a bottom on which the motor is secured and a housing cover in which the air inlet is formed, the housing cover including an upper part and a cover sidewall that extends from the upper part toward the bottom of the housing body and forms at least a part of the sidewall of the housing, and the housing cover is a pressed metal member, wherein the sidewall near a center of a side of the bottom is made of the pressed metal member of the housing cover, wherein the housing cover includes a wire guide portion extending radially outward from a bottom-side portion of the cover sidewall and being bent away from the bottom of the housing body.

* * * * *